US007798480B2

(12) United States Patent
Kikkawa et al.

(10) Patent No.: US 7,798,480 B2
(45) Date of Patent: Sep. 21, 2010

(54) SHEET PROCESSING APPARATUS AND SHEET CONVEYANCE METHOD

(75) Inventors: Naohiro Kikkawa, Kawasaki (JP); Kenji Yamada, Kawasaki (JP); Hiroshi Kubo, Kawasaki (JP); Shingo Matsushita, Yokohama (JP); Masahiro Tamura, Kawasaki (JP); Nobuyoshi Suzuki, Tokyo (JP); Shuuya Nagasako, Ebina (JP); Kazuhiro Kobayashi, Kawasaki (JP); Tomohiro Furuhashi, Fujisawa (JP); Tomoichi Nomura, Ichinomiya (JP); Hiroshi Maeda, Gifu (JP); Hitoshi Hattori, Tokyo (JP); Junichi Tokita, Yokohama (JP); Akira Kunieda, Tokyo (JP); Ichiro Ichihashi, Inuyama (JP); Makoto Hidaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 174 days.

(21) Appl. No.: 12/003,390

(22) Filed: Dec. 21, 2007

(65) Prior Publication Data

US 2008/0179809 A1 Jul. 31, 2008

(30) Foreign Application Priority Data

Dec. 25, 2006 (JP) ..... 2006-347845
Dec. 25, 2006 (JP) ..... 2006-347852

(51) Int. Cl.
*B65H 37/04* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.11, 58.12, 58.17, 58.27
See application file for complete search history.

(56) References Cited

U.S. PATENT DOCUMENTS

| | | | | |
|---|---|---|---|---|
| 7,445,203 | B2 * | 11/2008 | Kaneko | 270/58.08 |
| 7,568,686 | B2 * | 8/2009 | Terao et al. | 270/58.07 |
| 2003/0215275 | A1 | 11/2003 | Tamura et al. | |
| 2004/0256783 | A1 | 12/2004 | Iida et al. | |
| 2005/0067777 | A1 | 3/2005 | Iida et al. | |
| 2006/0022394 | A1 | 2/2006 | Tamura et al. | |
| 2006/0055100 | A1 | 3/2006 | Suzuki et al. | |
| 2006/0220293 | A1 * | 10/2006 | Kaneko | 270/58.08 |
| 2007/0052147 | A1 | 3/2007 | Tamura et al. | |
| 2007/0056423 | A1 | 3/2007 | Yamada et al. | |
| 2007/0063413 | A1 * | 3/2007 | Terao et al. | 270/58.12 |
| 2007/0147922 | A1 | 6/2007 | Iida et al. | |
| 2008/0315494 | A1 * | 12/2008 | Terao et al. | 270/58.12 |

FOREIGN PATENT DOCUMENTS

JP 05-147186 6/1993

(Continued)

*Primary Examiner*—Gene Crawford
*Assistant Examiner*—Leslie A Nicholson, III
(74) *Attorney, Agent, or Firm*—Harness, Dickey & Pierce, P.L.C.

(57) ABSTRACT

A sheet processing apparatus includes a sheet stacking member for temporarily receiving a sheet conveyed thereto and stacking the sheet thereon and a conveyance unit for outputting the sheet stacked on the sheet stacking member therefrom, wherein the conveyance unit includes a sheet output face having a predetermined acute angle with respect to a sheet stacking face of the sheet stacking member and configured to output a stack of sheets by touching a back end of the stack of sheets and pushing the stack of sheets.

9 Claims, 27 Drawing Sheets

FOREIGN PATENT DOCUMENTS

| | | |
|---|---|---|
| JP | 07-048063 | 2/1995 |
| JP | H10-324445 | 12/1998 |
| JP | 2000-219407 | 8/2000 |
| JP | 2003-002511 | 1/2003 |
| JP | 2003-176074 | 6/2003 |
| JP | 3617926 | 11/2004 |
| JP | 3619684 | 11/2004 |
| JP | 3655407 | 3/2005 |
| JP | 3655478 | 3/2005 |
| JP | 2006-044833 | 2/2006 |
| JP | 3924118 | 3/2007 |

* cited by examiner

SHEET PROCESSING APPARATUS AND SHEET CONVEYANCE METHOD

CROSS-REFERENCE TO RELATED APPLICATIONS

The present patent application claims priority under 35 U.S.C. §119 from Japanese Patent Application No. 2006-347845 filed on Dec. 25, 2006 and No. 2006-347852 filed on Dec. 25, 2006 in the Japan Patent Office, the entire contents and disclosure of which are hereby incorporated by reference herein.

BACKGROUND OF THE INVENTION

1. Field of the Invention

Preferred embodiments of the present invention generally relate to a sheet processing apparatus and a sheet conveyance method, and more particularly, to a sheet output technique for jogging and stapling a stack of sheets and outputting the stack of sheets while keeping the jogged state.

2. Discussion of the Related Art

In a sheet processing apparatus, a sheet after image formation is ejected from an image forming apparatus and temporarily stacked on a sheet stacking tray. Then, a jogging unit jogs a stack of sheets on the sheet stacking tray, and if instructed, a stapler staples the jogged stack of sheets. Subsequently, the stack of sheets is output by a sheet output nail to a sheet output tray from the sheet stacking tray.

For example, FIG. 42 shows a conventional sheet processing apparatus including a sheet jogging unit and a sheet output unit. FIG. 43 is a side view showing a magnified F area shown in FIG. 42. The sheet jogging unit includes an end fence 101 for jogging a stack of sheets in a sheet conveyance direction and a jogger fence 105 for jogging the stack of sheets in a direction perpendicular to the sheet conveyance direction. The sheet output unit includes a sheet output belt 107 extended over an output roller 103 and a driven roller 108 in parallel with the sheet conveyance direction and in a center zone of a processing tray 102, and a pair of sheet output nails 106 provided and projected on the sheet output belt 107.

A sheet ejected onto the processing tray 102 through a conveyance path, which is not shown, moves back by its own weight and a reverse roller, which is not shown, toward the end fence 101. A back end of a stack of sheets is jogged by touching the end fence 101. Each time when one sheet is ejected, the jogger fence 105 touches both sides of the sheet and jogs the stack of sheets in a width direction of the sheet such that a center of a sheet conveyance path and a center of the sheet coincide. When the stack of sheets to be output in one operation is jogged on the processing tray 102, the output roller 103 drives the sheet output belt 107, and the sheet output nail 106 pushes up the back end of the stack of sheets and conveys the stack of sheets to a downstream side of the sheet conveyance direction farther than the output roller 103. When an image forming apparatus instructs stapling the stack of sheets, a stapling unit 104 staples the back end of the stack of sheets before the sheet output nail 106 conveys the stack of sheets. When the image forming apparatus does not instruct stapling the stack of sheets, the stack of sheets is conveyed without being stapled to the downstream side. When being conveyed without being stapled, the stack of sheets may not maintain the jogged state while being conveyed.

For example, several known techniques have been proposed for outputting a stack of sheets while maintaining a jogged state thereof. In a technique shown in FIG. 42, a hook bent toward a sheet output direction is provided at a front end of each of the sheet output nails 106 for outputting a stack of sheets jogged and stacked on the processing tray 102, and a straightening member for pressing the front end of the stack of sheets is provided in an opposite side of the hook on each of the sheet output nails 106. In the technique, in order to maintain the jogged state of the stack of sheets, the front end of the stack of sheets is pressed toward a bottom of one sheet output nail 106 by using the straightening member of the other sheet output nail 106.

In another technique, in order to avoid curling of a stapled stack of sheets and keep a jogged state of a stack of sheet without stapling when the stack of sheets is output on a sheet output tray, an angle of the sheet output tray can be changed depending on whether or not the stack of sheets is stapled.

Each of the above two techniques employs a sheet stacking tray that inclines almost vertically, and a sheet output nail is required to convey a stack of sheets against gravity thereof. Another technique employs a horizontal sheet stacking tray as shown in FIG. 44. In the technique, a sheet output nail 8 conveys a stack of sheets that is stacked and jogged on an intermediate tray A in a horizontal direction and outputs the stack of sheets onto a sheet output tray B.

However, such techniques have drawbacks in that a stack of sheets is output on the sheet output tray B in a ragged state. When a sheet output face 8*a* of the sheet output nail 8 is vertical to a sheet stacking face A1 of the intermediate tray A, a back end of the stack of sheets that is output on the sheet output tray B is jogged along the vertical sheet output face 8*a*. The back end of the stack of sheets falls in a direction indicated by an arrow G and moves on the sheet output tray B toward a backboard 36 as shown in FIG. 45. At the moment, several lower sheets do not move due to gravity of upper sheets, and upper sheets only touch the backboard 36. As a result, the stack of sheets may not be output in the jogged state.

On the other hand, in the technique shown in FIG. 42 and FIG. 43, as the driven roller 108 is provided far below the processing tray 102, the stapling unit 104 requires to move so as to avoid the driven roller 108. When the stapling unit 104 moves along a width direction of a stack of sheets, a space for the stapling unit 104 to avoid the driven roller 108 is required. As a result, the conventional sheet processing apparatus shown in FIG. 42 increases in size. If the end fence 101 carries the stack of sheets to a position in which the stapling unit 104 does not interfere with the driven roller 108, the space for the stapling unit 104 to avoid the driven roller 108 is not required, and the size of the sheet processing apparatus may be smaller. However, in order to move the end fence 101, another drive unit for driving the end fence 101 is required. Thus, the sheet processing apparatus further increases in size and cost.

SUMMARY OF THE INVENTION

The present invention describes a novel sheet processing apparatus. In one preferred embodiment, a sheet processing apparatus includes a sheet stacking member configured to temporarily receive a sheet conveyed thereto and stack the sheet thereon and a conveyance unit configured to output the sheet stacked on the sheet stacking member therefrom, wherein the conveyance unit includes a sheet output face having a predetermined acute angle with respect to a sheet stacking face of the sheet stacking member and configured to output a stack of sheets by touching a back end of the stack of sheets and pushing the stack of sheets.

The present invention describes another novel sheet processing apparatus. In one preferred embodiment, a sheet processing apparatus configured to perform predetermined processing on a sheet conveyed thereto and to output the sheet therefrom includes a sheet stacking member configured to temporarily receive a sheet conveyed thereto and to stack the sheet, a first conveyance unit configured to convey the sheet by touching a back end of a stack of sheets stacked on the sheet stacking member and pushing the stack of sheets to a sheet transfer position, a second conveyance unit configured to receive the stack of sheets from the first conveyance unit in the sheet transfer position and to output the stack of sheets from the sheet stacking member, and a drive unit configured to drive the first conveyance unit and the second conveyance unit by using driving force supplied from a single drive source.

The present invention further describes a novel sheet conveyance method. In one preferred embodiment, a sheet conveyance method for conveying a stack of sheets in a sheet processing apparatus includes the steps of temporarily receiving a sheet conveyed to a sheet stacking member and stacking the sheet thereon, conveying a stack of sheets stacked on the sheet stacking member to a sheet transfer position, and outputting the stack of sheets conveyed to the sheet transfer position from the sheet stacking member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
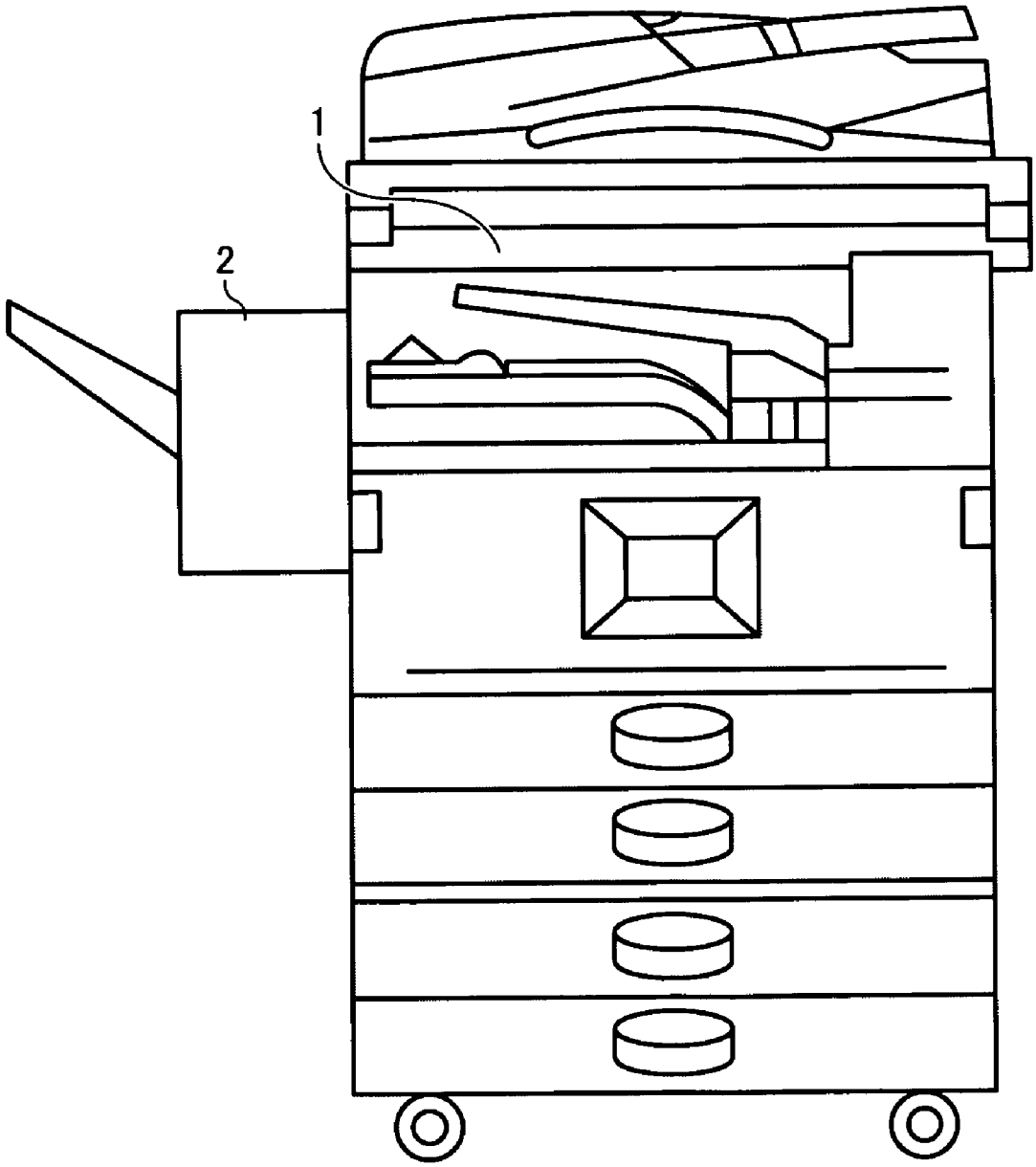
FIG. 1 is a schematic illustration showing a system configuration of an image forming apparatus of a preferred embodiment according to the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views, preferred embodiments of the present invention are described. It should be noted that the present invention is not limited to any preferred embodiment described in the drawings.

FIG. 1 shows a system configuration of an image forming apparatus of a preferred embodiment according to the present invention. The system configuration is formed of an apparatus body of an image forming apparatus 1 and a sheet post-processing apparatus 2 as a sheet processing apparatus. The sheet post-processing apparatus 2 is attached to a side of the apparatus body of the image forming apparatus 1. A sheet on which an image has been formed is conveyed to the sheet post-processing apparatus 2 from an ejection opening provided on the side of the image forming apparatus 1 and is subjected to predetermined processing. The image forming apparatus 1 includes composite functions such as a copier, a printer, a facsimile, and so forth.

Figure 2:
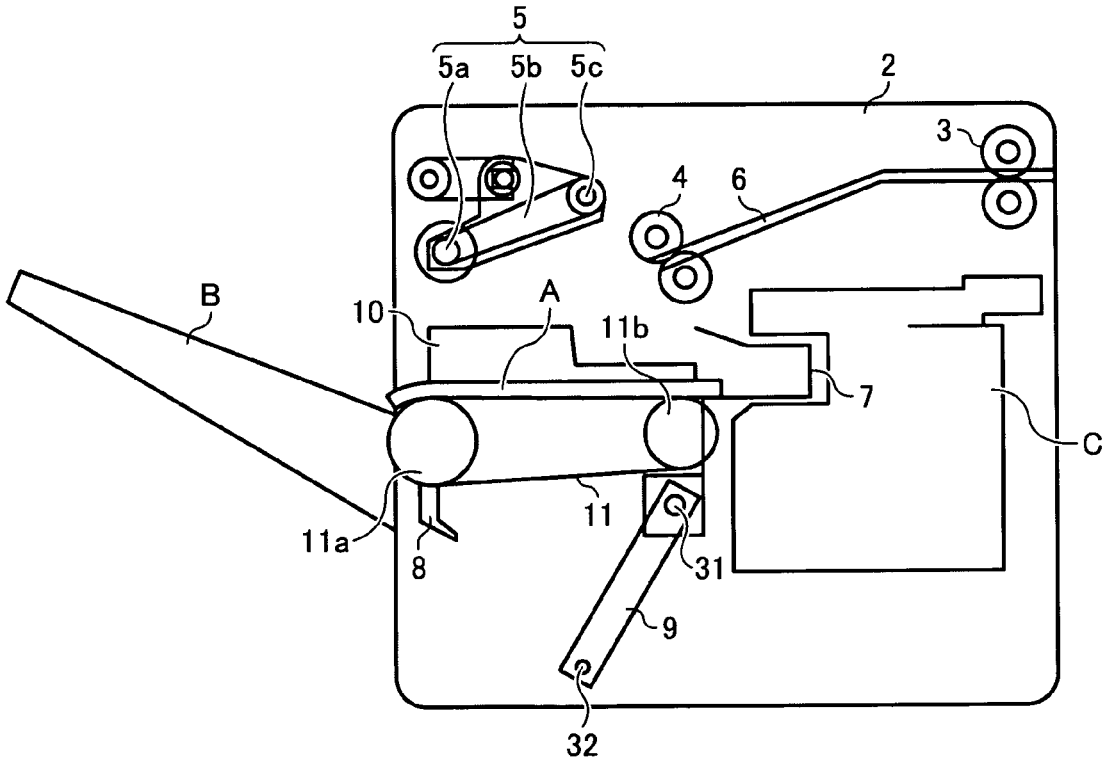
FIG. 2 is a cross-sectional view schematically showing a sheet jogging unit of a sheet post-processing apparatus of the present preferred embodiment in detail.

FIG. 2 shows a sheet jogging unit of the sheet post-processing apparatus 2 in detail. In FIG. 2, the sheet jogging unit of the sheet post-processing apparatus 2 includes entry rollers 3, ejection rollers 4, a conveyance guide plate 6, an intermediate tray A, a sheet output tray B, a reverse roller unit 5, a jogger fence 10, an end fence 7, a sheet output nail 8, an arm 9, a sheet output belt 11, and a stapler C. Each sheet ejected from the image forming apparatus 1 enters to the sheet post-processing apparatus 2 through the entry rollers 3. Then, a stack of sheets is jogged vertically and horizontally on the intermediate tray A and output to the sheet output tray B while keeping the jogged state. The entry rollers 3, which are provided on a farthest upstream side of the conveyance guide plate 6, are rotationally driven by a conveyance motor, which is not shown. In addition, an entry sensor, which is not shown, to detect a sheet entry is provided on a farthest upstream side of the conveyance guide plate 6.

The reverse roller unit 5 is oppositely provided to a sheet stacking face A1, which is not shown hereat, of the intermediate tray A. The reverse roller unit 5 is formed of a reverse roller 5*a* to convey each sheet and an arm 5*b* to support the reverse roller 5*a*. The arm 5*b* is rotatably born by a rotational shaft 5*c*. The reverse roller 5*a* is rotationally driven by a motor, which is not shown, and moves back the sheet toward an upstream side in a sheet output direction. At the same time, the reverse roller 5*a* is swingably driven around the rotational shaft 5*c* by a solenoid, which is not shown. When the solenoid is turned on, the reverse roller 5*a* moves up, and when the solenoid is turned off, the reverse roller 5*a* moves down to a position to move back a sheet by its own weight. In other words, the solenoid is turned off such that the reverse roller 5*a* contacts the sheet to move back the sheet, and the solenoid is turned on such that the reverse roller 5*a* neither contacts the intermediate tray A nor the sheet.

Figure 3:
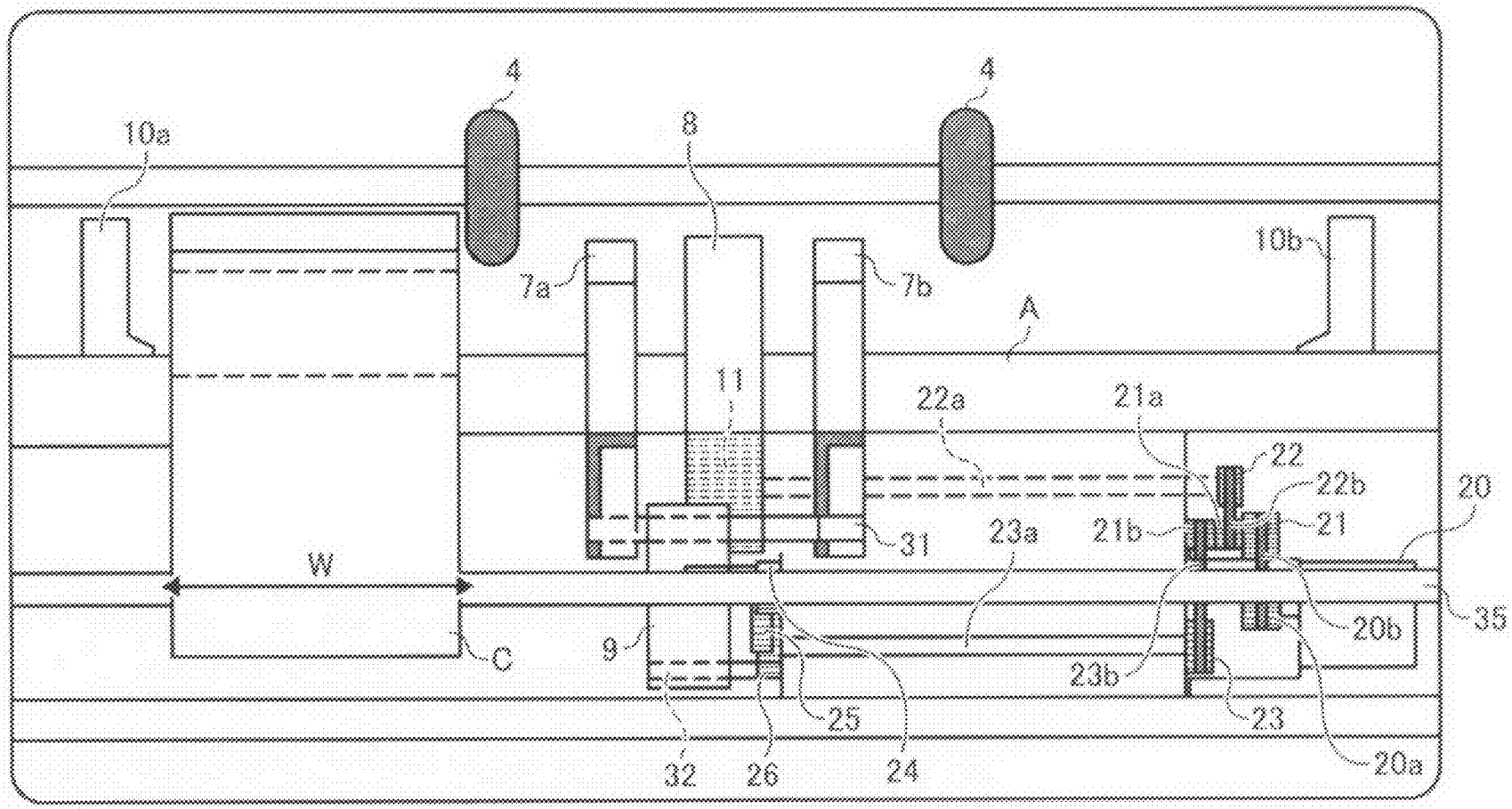
FIG. 3 is a side view of the sheet jogging unit shown in FIG. 2 when viewed from a right side of the sheet post-processing apparatus.
Figure 4:
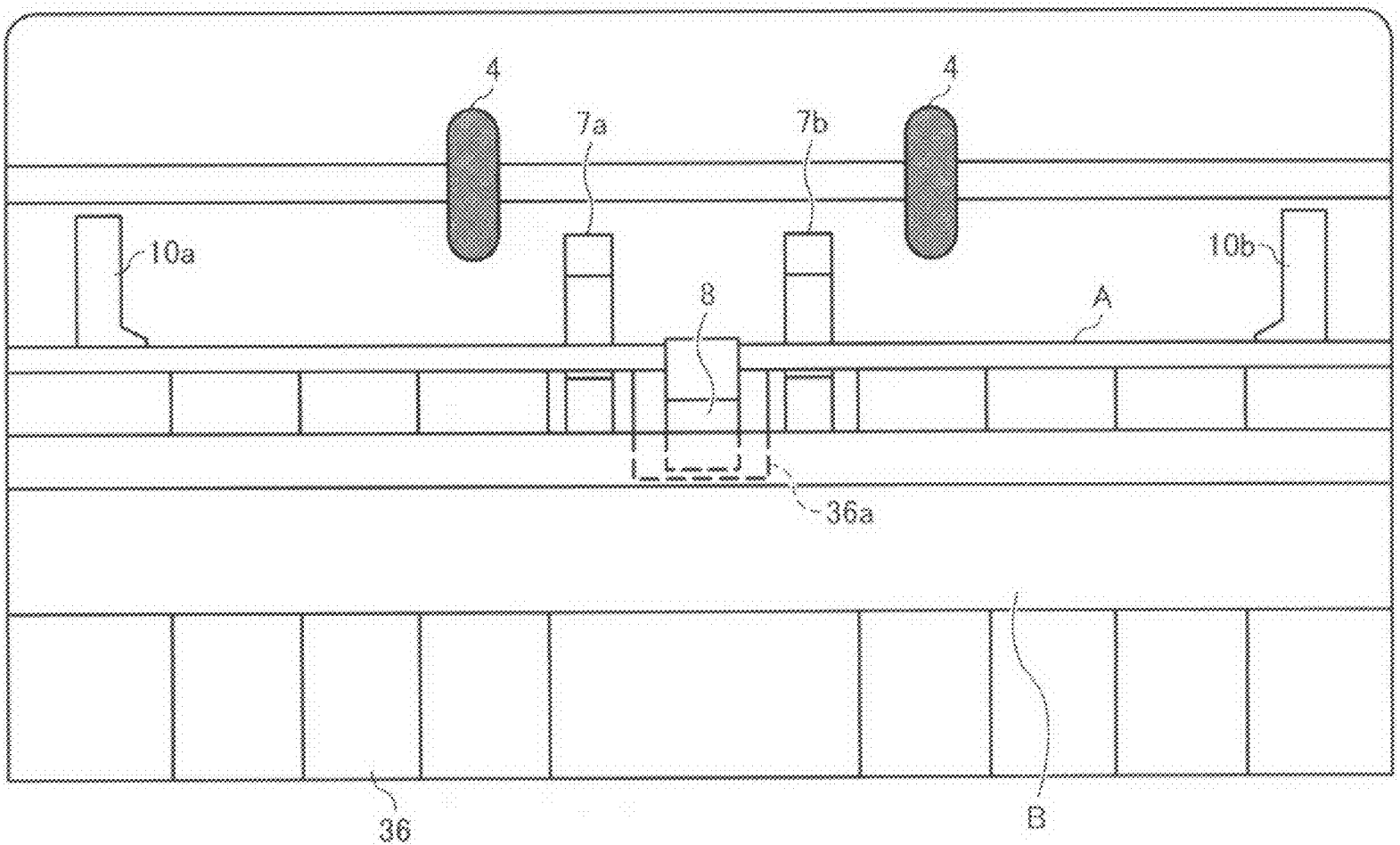
FIG. 4 is a side view of the sheet jogging unit shown in FIG. 2 when viewed from a left side of the sheet post-processing apparatus.

FIG. 3 is a side view of the sheet jogging unit shown in FIG. 2 when viewed from a right side of the sheet post-processing apparatus 2 (an upstream side in a sheet output direction). FIG. 4 is a side view of the sheet jogging unit shown in FIG. 2 when viewed from a left side of the sheet post-processing apparatus 2 (a downstream side in a sheet output direction). In FIGS. 3 and 4, the end fence 7 is formed of end fences 7*a* and 7*b* in a front side and back side of the sheet post-processing apparatus 2, respectively, and is supported by a first shaft 31 that is inserted into a free end of the arm 9. A fixed end of the arm 9 is swingably supported by a second shaft 32. The sheet output nail 8 is provided on an outer circumference face of the sheet output belt 11 extended between a pair of sheet output nail driving pulleys 11*a* and 11*b* so as to project toward an outside of the sheet output belt 11. When the sheet output nail driving pulleys 11*a* and 11*b* are rotationally driven, the sheet output nail 8 and the sheet output belt 11 rotate together. A front end of the sheet output nail 8 is inclined so as to hold the stack of sheets ST. That is to say, the sheet output nail 8 is formed in a shape such that to the sheet output nail 8 can successfully output the stack of sheets ST.

The sheet output nail driving pulley 11*a* is inserted and fixed to a sheet output nail driving shaft 22*a* extended from a center of a sheet output nail driving force transmission pulley 22 toward an axial direction of the sheet output nail driving force transmission pulley 22. Rotational driving force of the sheet output nail driving force transmission pulley 22 is transmitted to the sheet output nail driving pulley 11*a* through the sheet output nail driving shaft 22*a* (refer to FIG. 6). By receiving the driving force, the sheet output nail driving pulley 11*a* moves the sheet output belt 11 extended between the sheet output nail driving pulleys 11*a* and 11*b*, thus enabling the stack of sheets ST to be output.

As shown in FIG. 4, an opening 36*a* is formed on a backboard 36 of the sheet post-processing apparatus 2 such that the backboard 36 does not interfere with moving of the sheet output nail 8. The opening 36*a* is cut out to be larger than the sheet output nail 8 so as to enable the sheet output nail 8 to move smoothly. Therefore, a user may put his or her finger into the opening 36*a*. If a user put his or her finger into the opening 36*a*, the user may get injured, or disordering of the sheet post-processing apparatus 2 may occur by touching the internal members. In order not to allow a user to put his or her finger into the opening 36*a*, a home position of the sheet output nail 8 is set to a position close to the backboard 36 as shown in FIG. 2. Thereby, the opening 36*a* is closed by a backside of the sheet output nail 8, and a user cannot put his or her finger into the opening 36*a*.

The end fence 7 and the sheet output nail 8 are driven by one motor 20 as a driving source. As for the motor 20, a stepping motor is employed in the present preferred embodiment for the sake of ease in controlling. A timing of driving force transmission to each of the end fence 7 and the sheet output nail 8 is independently controlled while the motor 20 continuously operates, and the jogged stack of sheets ST is conveyed from the intermediate tray A toward the sheet output tray B.

Figure 5:
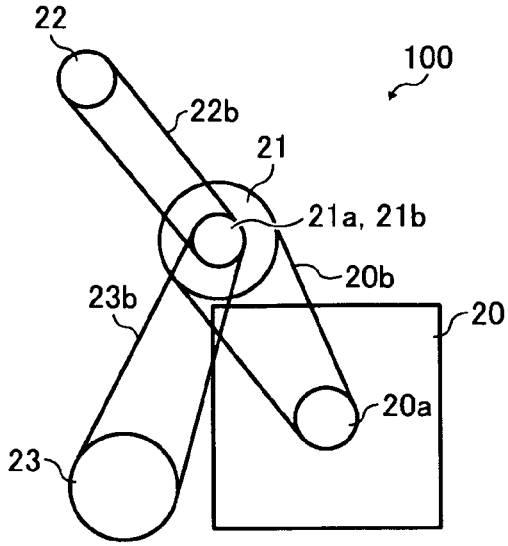
FIG. 5 is a diagram schematically showing a sheet conveyance driving unit for driving an arm (an end fence) and a sheet output nail.

FIG. 5 schematically shows a sheet conveyance driving unit 100 for driving the arm 9 (the end fence 7) and the sheet output nail 8. The sheet conveyance driving unit 100 includes the motor 20, a driving pulley 20*a* that is inserted and fixed to a rotational shaft of the motor 20, a relay pulley 21, the sheet output nail driving force transmission pulley 22, and an arm driving force transmission pulley 23. In addition, the sheet conveyance driving unit 100 includes a first driving force transmission pulley 21*a* and a second driving force transmission pulley 21*b* that integrally rotate with the relay pulley 21. Further, a first timing belt 20*b*, a second timing belt 22*b*, and a third timing belt 23*b* are stretched between the driving pulley 20*a* and the relay pulley 21, between the first driving force transmission pulley 21*a* and the sheet output nail driving force transmission pulley 22, and between the second driving force transmission pulley 21*b* and the arm driving force transmission pulley 23, respectively. Thus, the driving force of the motor 20 is transmitted to the relay pulley 21 via the first timing belt 20*b*, and the driving force transmitted to the relay pulley 21 is transmitted to the sheet output nail driving force transmission pulley 22 and the arm driving force transmission pulley 23 via the second and third timing belts 22*b* and 23*b*, respectively.

FIGS. 6, 7, 8, and 9 are perspective views showing operations of the sheet conveyance driving unit 100 shown in FIG. 5 in detail. The sheet output nail driving shaft 22*a* that is shown in FIG. 3 and an arm driving shaft 23*a* are attached to the sheet output nail driving force transmission pulley 22 and the arm driving force transmission pulley 23, respectively, as shown in FIG. 5, such that the sheet output nail driving shaft 22*a* and the arm driving shaft 23*a* integrally rotate with the sheet output nail driving force transmission pulley 22 and the arm driving force transmission pulley 23, respectively. Thereby, as described above, the sheet output nail driving shaft 22*a* drives the sheet output nail driving pulley 11*a* and rotationally drives the sheet output belt 11 extended between the pair of the sheet output nail driving pulleys 11*a* and 11*b* in a counterclockwise direction in FIGS. 6, 7, 8, and 9.

Figure 6:
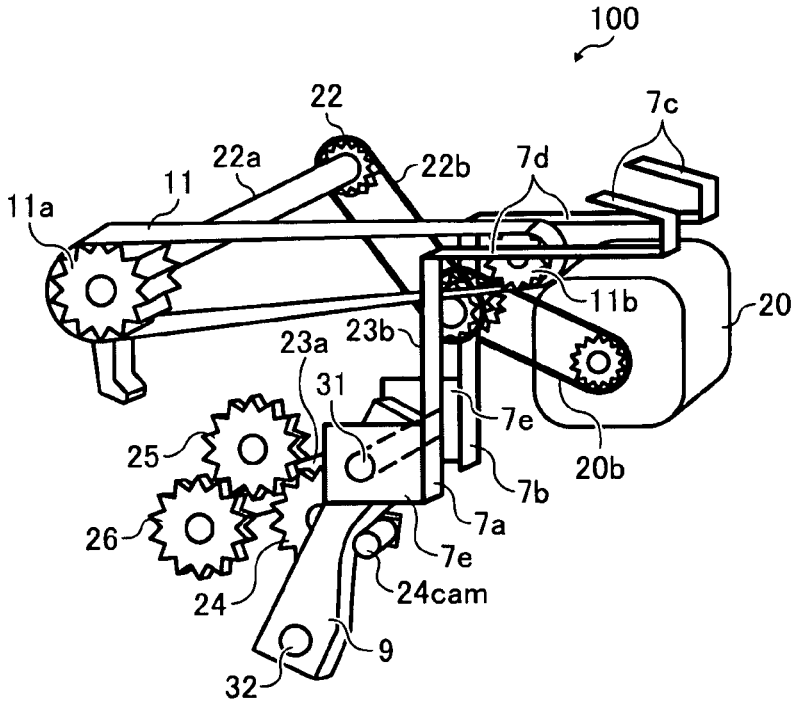
FIG. 6 is a perspective view showing an operation of the sheet conveyance driving unit shown in FIG. 5 in detail and also showing a state of the sheet conveyance driving unit when the sheet conveyance driving unit accepts a sheet.

As shown in FIGS. 2 and 6, the end fences 7*a* and 7*b* (when the end fence is represented with a numerical reference of 7, the end fence 7 includes both of the end fences 7*a* and 7*b*) are provided in a back end side of a sheet. The end fence 7 includes a pair of receiving members 7*c*, a pair of fence body members 7*d* of a hook-shape when viewed from a front side of the sheet post-processing apparatus 2, and a pair of fixed end members 7*e* that are attached to the arm 9 via the first shaft 31. The arm 9 supports the pair of fixed end members 7*e* of the respective end fences 7*a* and 7*b* and drives and reciprocates the end fence 7 straight. The arm 9 is elastically and continuously energized by a tensile spring 29 (shown in FIGS. 13 and 14) toward the upstream side of the sheet output direction while being driven by the sheet conveyance driving unit 100.

Figure 7:
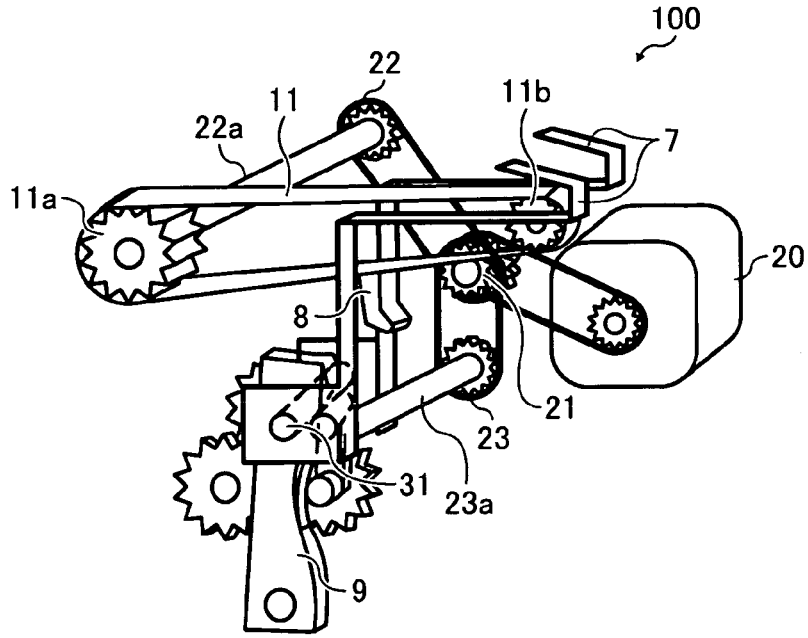
FIG. 7 is a perspective view showing an operation of the sheet conveyance driving unit shown in FIG. 5 in detail and also showing a state of the sheet conveyance driving unit right after the end fence and the sheet output nail start to move.
Figure 8:
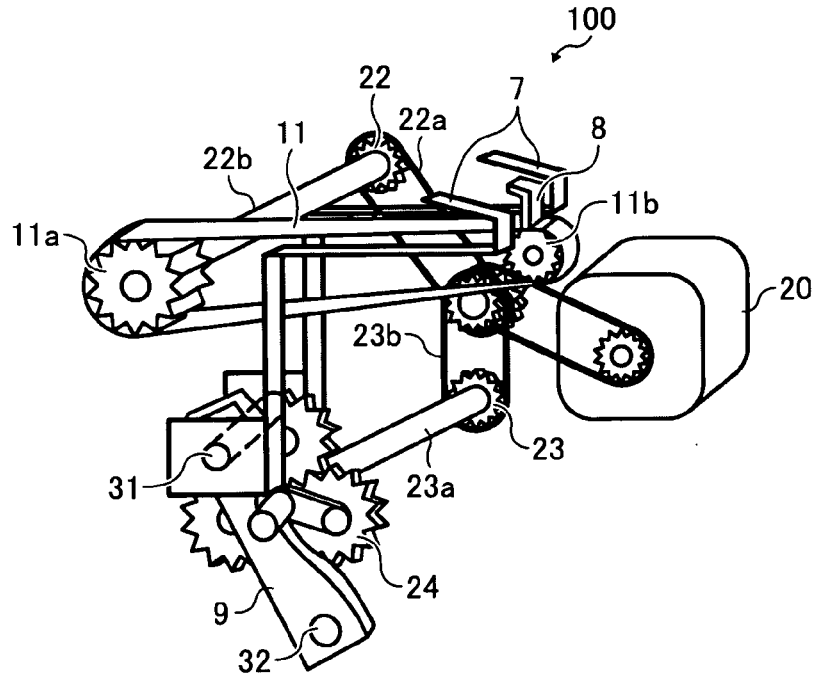
FIG. 8 is a perspective view showing an operation of the sheet conveyance driving unit shown in FIG. 5 in detail and also showing a state of each member of the sheet conveyance driving unit at a sheet transfer position.
Figure 9:
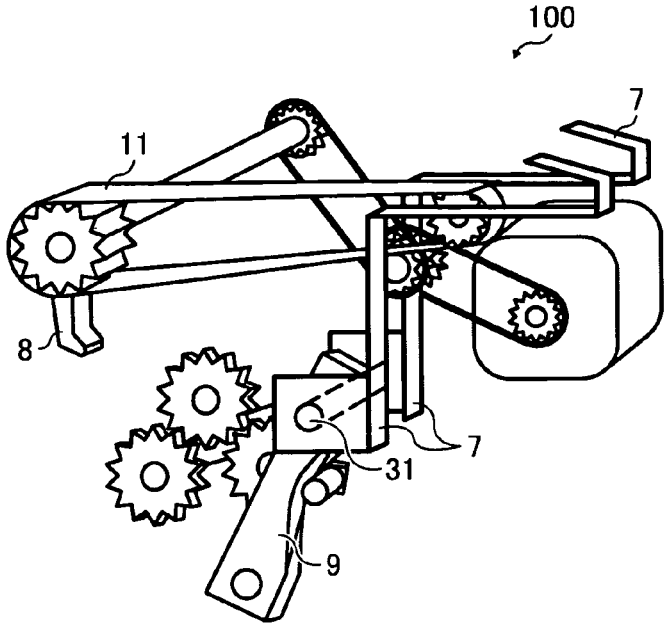
FIG. 9 is a perspective view showing an operation of the sheet conveyance driving unit shown in FIG. 5 in detail and also showing a state of the sheet conveyance driving unit when each member returns to the home position after one set of sheets is output.

FIG. 6 shows a state of the sheet conveyance driving unit 100 when the sheet conveyance driving unit 100 accepts a sheet. FIG. 7 shows a state of the sheet conveyance driving unit 100 right after the end fence 7 and the sheet output nail 8 start to move. FIG. 8 shows a state of each member of the sheet conveyance driving unit 100 in a sheet transfer position P (refer to FIG. 17). FIG. 9 shows a state of the sheet conveyance driving unit 100 when each member returns to the home position thereof after one stack of sheets is output.

Figure 10:
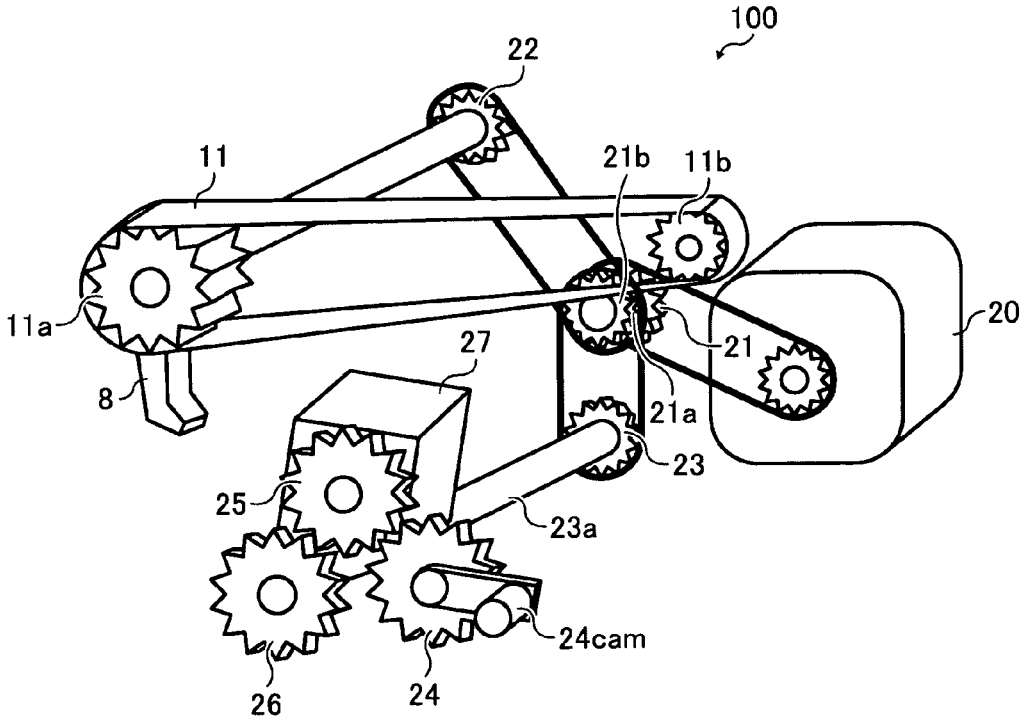
FIG. 10 is a perspective view showing substantial members of the sheet conveyance driving unit.

FIG. 10 is a perspective view showing substantial members of the sheet conveyance driving unit 100. In the sheet conveyance driving unit 100, a mechanism to drive the arm 9 is formed of an arm driving force transmission gear 26, an intermediate gear 25, an arm driving gear 24, a driving force transmission cam 24*cam*, a solenoid 27, and a fixing member 28. The arm driving force transmission gear 26 is attached to an opposite end of the arm driving shaft 23*a* to the end attached to the arm driving force transmission pulley 23 so as to integrally and coaxially rotate with the arm driving shaft 23*a*. The intermediate gear 25 engages with both of the arm driving force transmission gear 26 and the arm driving gear 24 and transmits the driving force transmitted to the arm driving force transmission gear 26 to the arm driving gear 24. On an edge area of the arm driving gear 24, the driving force transmission cam 24*cam* is provided so as to concentrically rotate with the arm driving gear 24. The driving force transmission cam 24*cam* protrudes outside an outer circumference of the arm driving gear 24, contacts an upstream side of the arm 9 in the sheet output direction, and swingably drives the arm 9 while rotating.

Figure 11:
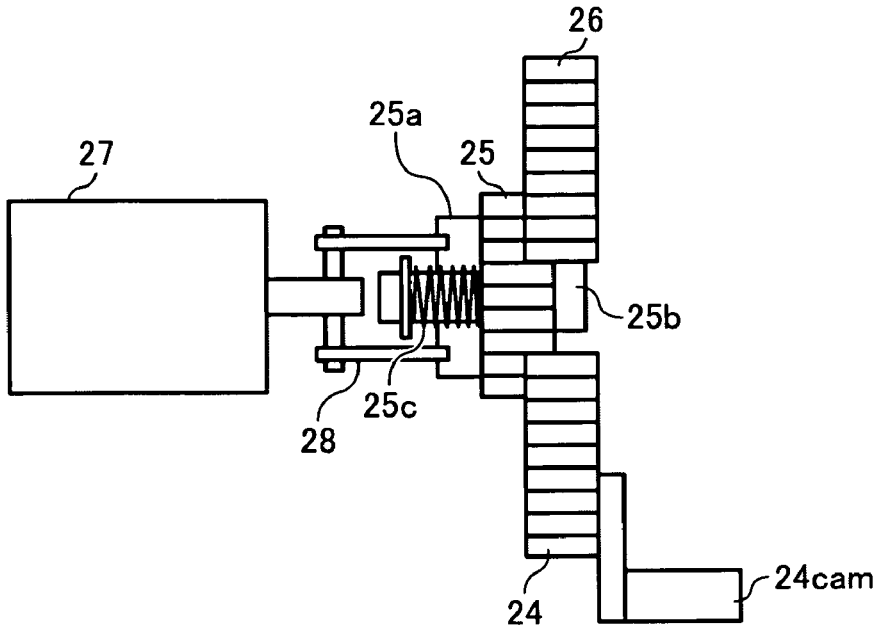
FIG. 11 is a schematic illustration explaining an operation of an intermediate gear of the sheet conveyance driving unit and showing that the intermediate gear transmits the driving force.
Figure 12:
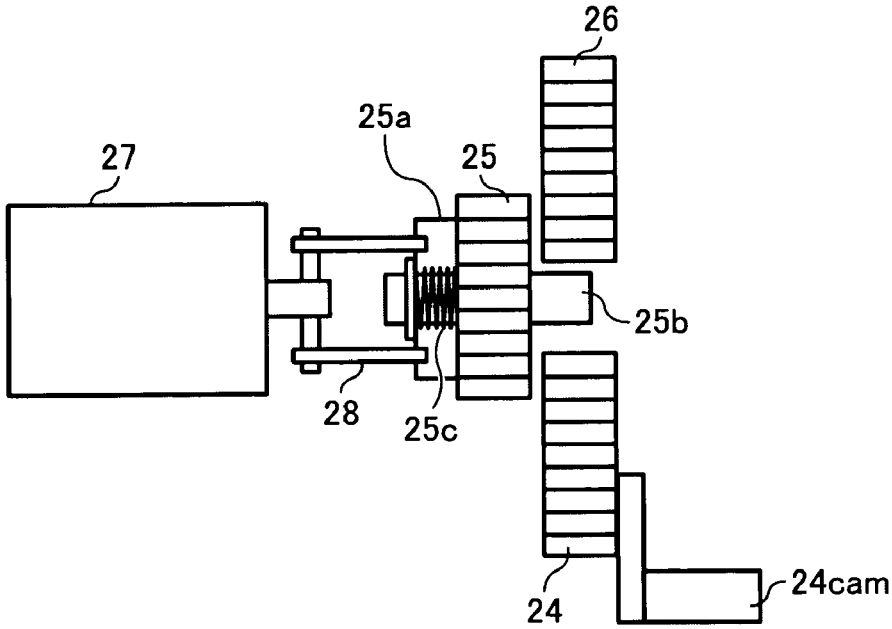
FIG. 12 is a schematic illustration explaining an operation of an intermediate gear of the sheet conveyance driving unit and showing that the intermediate gear interrupts the driving force.

As shown in FIGS. 11 and 12, the intermediate gear 25 is provided between the arm driving force transmission gear 26 and the arm driving gear 24 such that the intermediate gear 25 can shift forward and backward. The intermediate gear 25 changes a driving timing between the arm driving force transmission gear 26 and the arm driving gear 24. The driving timing change between the arm driving force transmission gear 26 and the arm driving gear 24 also causes the driving timing change between the end fence 7 and the sheet output nail 8. In order to change the driving timing, the intermediate gear 25 is supported by an idle member 25*a* and a shaft 25*b* in a thrust direction of the shaft 25*b* in a slidable manner and is rotatably supported by the idle member 25*a*. The idle member 25*a* is connected to the solenoid 27 via the fixing member 28 and continuously and elastically energized by a compressional spring 25*c* provided around the shaft 25*b* in a direction of the engagement of the intermediate gear 25 with the arm driving force transmission gear 26 and the arm driving gear 24. Corresponding to an on-off action of the solenoid 27, the intermediate gear 25 reciprocates in the thrust direction and can engage or cannot engage with the arm driving force transmission gear 26 and the arm driving gear 24. FIG. 11 shows a state that the intermediate gear 25 engages with the arm driving force transmission gear 26 and the arm driving gear 24, and the arm driving force transmission gear 26 transmits the driving force to the arm driving gear 24 to drive the driving force transmission cam 24*cam*. FIG. 12 shows a state that the intermediate gear 25 separates from the arm driving force transmission gear 26 and the arm driving gear 24 and does not engage therewith, in other words, shows a state of the driving timing change between the arm driving force transmission gear 26 and the arm driving gear 24. During the driving timing change, since the driving force to the end fence 7 is interrupted, and the end fence 7 is not driven whereas the sheet output nail 8 is still driven.

Figure 13:
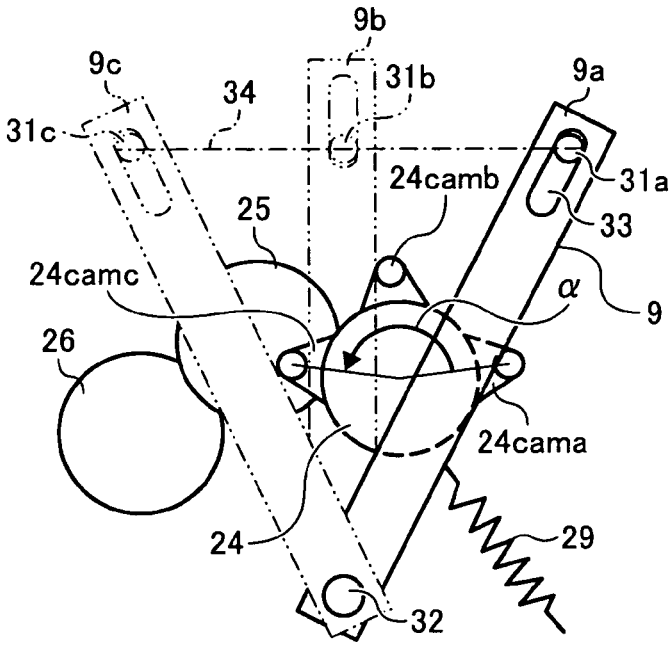
FIG. 13 is a schematic illustration explaining operations of an arm driving gear, a driving force transmission cam, and an arm for driving the end fence when the end fence goes to the sheet transfer position from the home position.
Figure 14:
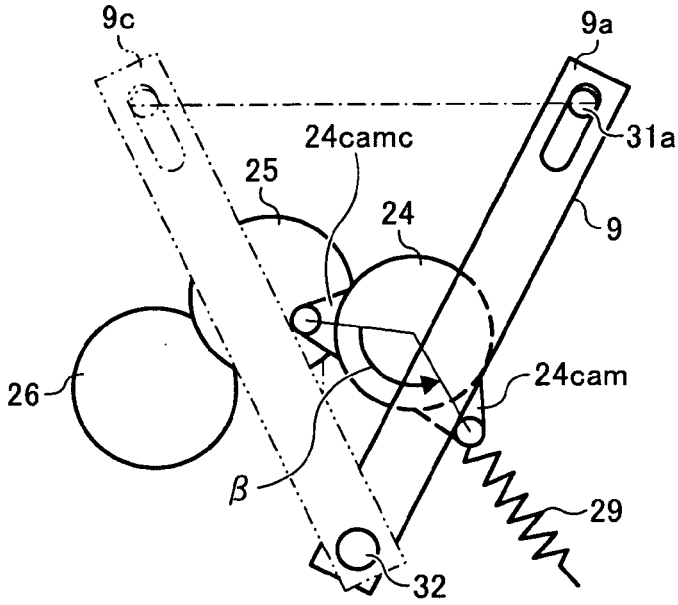
FIG. 14 is a schematic illustration explaining operations of the arm driving gear, the driving force transmission cam, and the arm for driving the end fence when the end fence returns to the home position from the sheet transfer position.

FIGS. 13 and 14 show operations of the arm driving gear 24, the driving force transmission cam 24*cam*, and the arm 9 that drive the end fence 7. The arm driving gear 24 receives the driving force from the motor 20 via the arm driving force transmission gear 26 and the intermediate gear 25. The solenoid 27 and the idle member 25*a* control the arm driving gear 24 by transmitting or interrupting the driving force to the arm driving gear 24. In FIG. 13, when the arm 9 is in a position of a reference numeral 9*a* (position 9*a*), the end fence 7 is in the home position thereof and in a state corresponding to the state shown in FIG. 9. In the home position, the end fence 7 waits to receive a sheet.

FIG. 13 shows an operation that the end fence 7 moves to the sheet transfer position P from the home position thereof. When the end fence 7 moves to the sheet transfer position P, the arm 9 moves from the position 9*a* through a position 9*b* to a position 9*c*. More specifically, the driving force transmission cam 24*cam* pushes the upstream side of the arm 9 in the sheet output direction while opposing the elastic energy of the tensile spring 29 as the arm driving gear 24 rotates by α degrees in a counterclockwise direction in accordance with rotation of the motor 20. When the arm 9 is in the position 9*c*, the end fence 7 transfers the stack of sheets ST to the sheet output nail 8 in the sheet transfer position as shown in FIG. 8. The first shaft 31 is straight driven from the 9*a* position to the 9*c* position by the arm 9. Thus, the end fence 7 straight moves from the home position thereof to the sheet transfer position P in accordance with the first shaft 31. In order to move the end fence 7 straight, the first shaft 31 is loosely fitted to a slot 33 formed on the free end of the arm 9. Thus, inside the slot 33, the first shaft 31 is first in a position 31*a* when the end fence 7 is in the home position thereof, and moves to a position 31*b* when the end fence 7 moves to the sheet transfer position P (the arm 9 is in the position 9*b*), and then to a position 31*c* when the end fence 7 is in the sheet transfer position P. As a result, the first shaft 31 moves along a straight horizontal line 34. The driving force transmission cam 24*cam* moves from a position 24*cama* through a position 24*camb* to a position 24*camc* as swingably driving the arm 9 from the position 9*a* through the position 9*b* to the position 9*c*.

FIG. 14 shows an operation that the end fence 7 returns to the home position thereof from the sheet transfer position P. When the end fence 7 returns to the home position, the arm 9 returns to the 9*a* position from the 9*c* position by elastic force of the tensile spring 29 as the arm driving gear 24 further rotates by β degrees in a counterclockwise direction from the 24*camc* position. More specifically, after the arm 9 returns to the 9*a* position shown in FIG. 14, the driving force transmission cam 24*cam* returns to the 24*cama* position shown in FIG. 13. At the point, when the driving force transmission cam 24*cam* returns to the 24*cama* position, the arm 9 stays in the 9*a* position. That is to say, when the arm 9 returns to the 9*a* position, the driving force transmission cam 24*cam* returns to the 24*cama* position after making one revolution. Hereat, the arm driving gear 24 rotates at a constant velocity, and the angle β is smaller than the angle α. Thus, the end fence 7 takes a shorter time period to return to the home position thereof than to move to the sheet transfer position P. As a result, the intermediate tray A can accept another sheet earlier, and the sheet post-processing apparatus 2 can handle stacks of sheets more efficiently.

Hereat, it should be noted that a reduction ratio of the plurality of pulleys (the driving pulley 20*a*, the relay pulley 21, the first driving force transmission pulley 21*a*, the sheet output nail driving force transmission pulley 22, and the sheet output nail driving pulley 11*a*) for transmitting the driving force from the motor 20 to the sheet output nail 8 and a reduction ratio of the plurality of pulleys and gears (the driving pulley 20*a*, the relay pulley 21, the second driving force transmission pulley 21*b*, the arm driving force transmission pulley 23, the arm driving force transmission gear 26, and the intermediate gear 25) for transmitting the driving force from the motor 20 to the arm driving gear 24 are adjusted such that the arm driving gear 24 makes one revolution when the sheet output nail 8 makes one revolution with the sheet output belt 11. During the one revolution of the arm driving gear 24, the end fence 7 moves the stack of sheets ST to the sheet transfer position P from the home position thereof, and the sheet output nail 8 receives the stack of sheets ST at the sheet transfer position P and outputs the stack of sheets ST toward the sheet output tray B.

Figure 15:
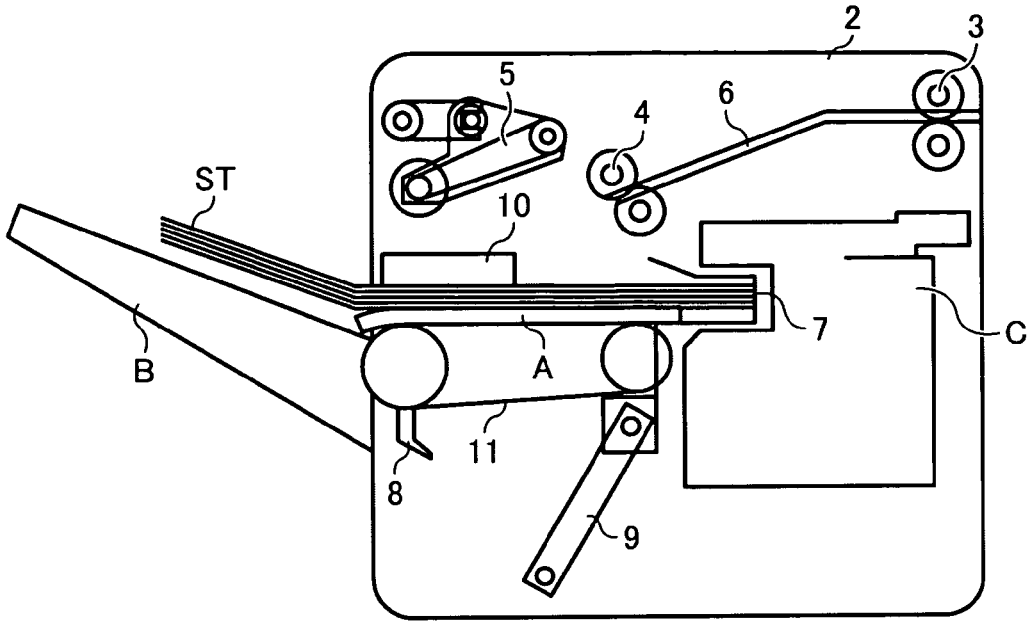
FIG. 15 is a cross-sectional view schematically explaining an operation of the sheet post-processing apparatus and showing a state that all of sheets to be output one time are ejected on an intermediate tray A while a front end of the sheets is on a sheet output tray.

FIGS. 15, 16, 17, 18, 19, and 20 show operations of the sheet post-processing apparatus 2 according to the present preferred invention. FIG. 15 shows a state that all of sheets to be output one time (the stack of sheets ST) are ejected on the intermediate tray A while a front end of the stack of sheets ST is on the sheet output tray B. Each time one sheet is ejected, the sheet is moved back by the reverse roller 5*a* toward the end fence 7. Each sheet reaches the end fence 7, and thereby the stack of sheets ST is jogged in the sheet output direction. At the same time, the jogger fences 10*a* and 10*b* (refer to FIG. 3 or 4) jog the stack of sheets ST in a direction perpendicular to the sheet output direction by touching both major sides of the stack of sheets ST. By repeating the above operations, the stack of sheets ST is jogged as shown in FIG. 15. In the state of FIG. 15, the arm 9 is in the position 9*a* in FIG. 13, and the end fence 7 and the sheet output nail 8 are in the home position shown in FIG. 9. In the state, when a user instructs to staple the stack of sheets ST, the stapler C moves to a stapling position and staples the stack of sheets ST according to a stapling instruction signal that has sent to the sheet post-processing apparatus 2 from the image forming apparatus 1 in advance. The stapling instruction signal instructs a stapling number and position to the stapler C, such as one point bias stapling, two point stapling, or the like. When stapling, the stapler C linearly moves in parallel with the back end of the stack of sheets ST along a guide pole 35 shown in FIG. 3, that is to say, in a direction indicated by an arrow W.

Figure 16:
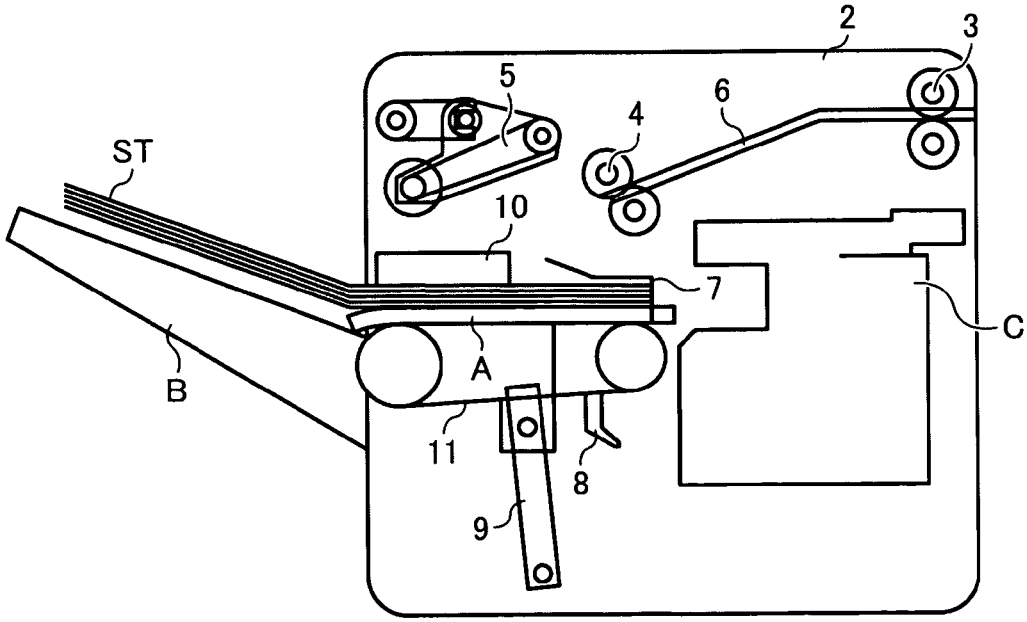
FIG. 16 is a cross-sectional view schematically explaining an operation of the sheet post-processing apparatus and showing a state that the sheets are conveyed by the end fence.

When the stapling is completed or the ejection of the stack of sheets ST is completed as shown in FIG. 15 if the stapling is not instructed, the end fence 7 and the sheet output nail 8 start to move in synchronization with each other as the motor 20 revolves and transmits the driving force to the sheet output nail driving pulley 11*a* and the arm driving force transmission gear 26 as described above with reference to the sheet conveyance driving unit 100. Then, the end fence 7 moves the stack of sheets ST toward the sheet output tray B as shown in FIG. 16. In the state of FIG. 16, the arm 9 is in the position 9*b* in FIG. 13, and the end fence 7 and the sheet output nail 8 move toward the sheet transfer position P as shown in FIG. 7.

Figure 17:
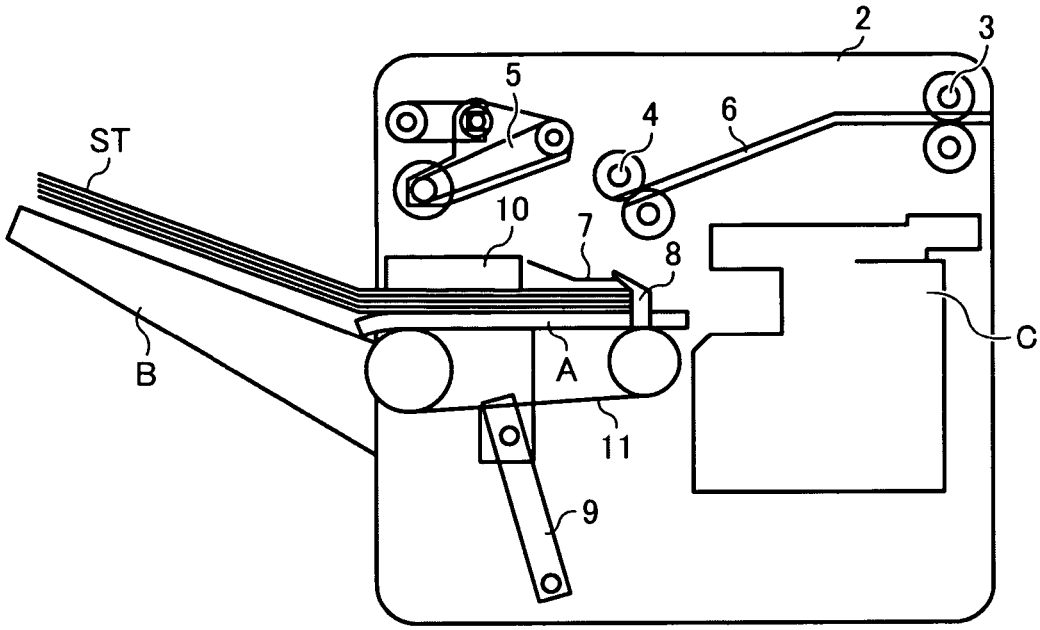
FIG. 17 is a cross-sectional view schematically explaining an operation of the sheet post-processing apparatus and showing a state that the sheets reaches the sheet transfer position and the sheet output nail receives the sheets from the end fence.

As shown in FIG. 17, when reaching the sheet transfer position P, the end fence 7 pauses for a predetermined time period. While the end fence 7 pauses, the sheet output nail 8 comes up with the end fence 7 and takes over the output of the stack of sheets ST toward the sheet output tray B from the end fence 7. In other words, the stack of sheets ST is carried by the sheet output nail 8 toward the sheet output tray B from the sheet transfer position P. In the state of FIG. 17, the arm 9 is in the position 9*c* in FIG. 13, and the end fence 7 and the sheet output nail 8 are in the sheet transfer position P as shown in FIG. 8. The end fence 7 is stopped in the sheet transfer position P by the above-described operation between the intermediate gear 25 and the solenoid 27. Alternatively, a shape of the side of the arm 9 on which the driving force transmission cam 24*cam* contacts the arm 9, which is a cam follower, can be designed such that the end fence 7 pauses at the sheet transfer position P.

Figure 18:
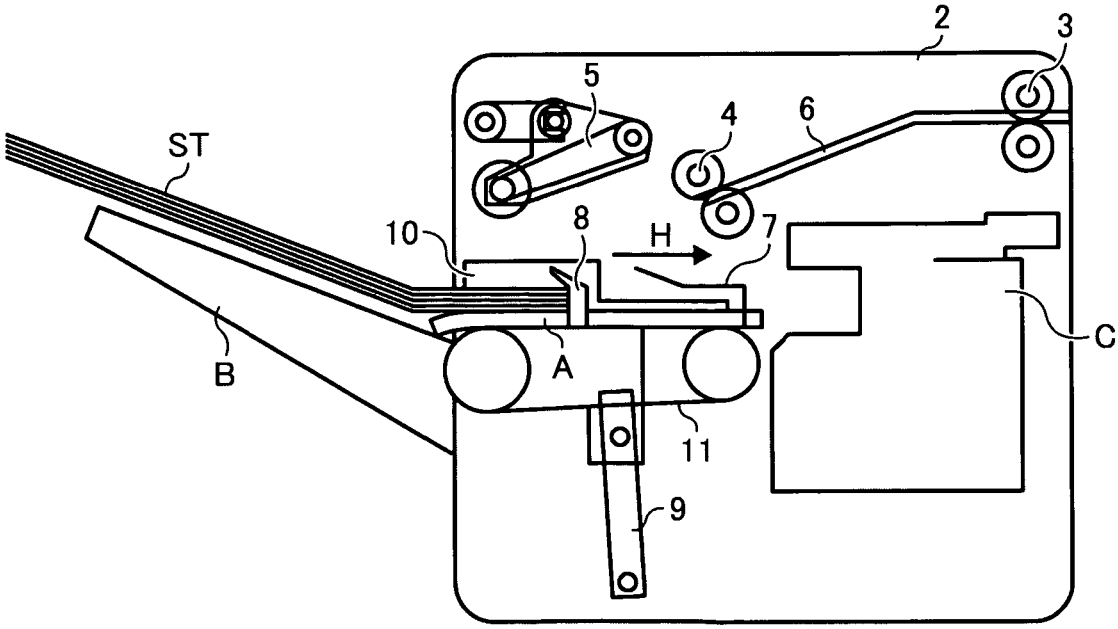
FIG. 18 is a cross-sectional view schematically explaining an operation of the sheet post-processing apparatus and showing a state that the sheet output nail takes over the output of the sheets from the end fence and carries the sheets toward the sheet output tray.
Figure 19:
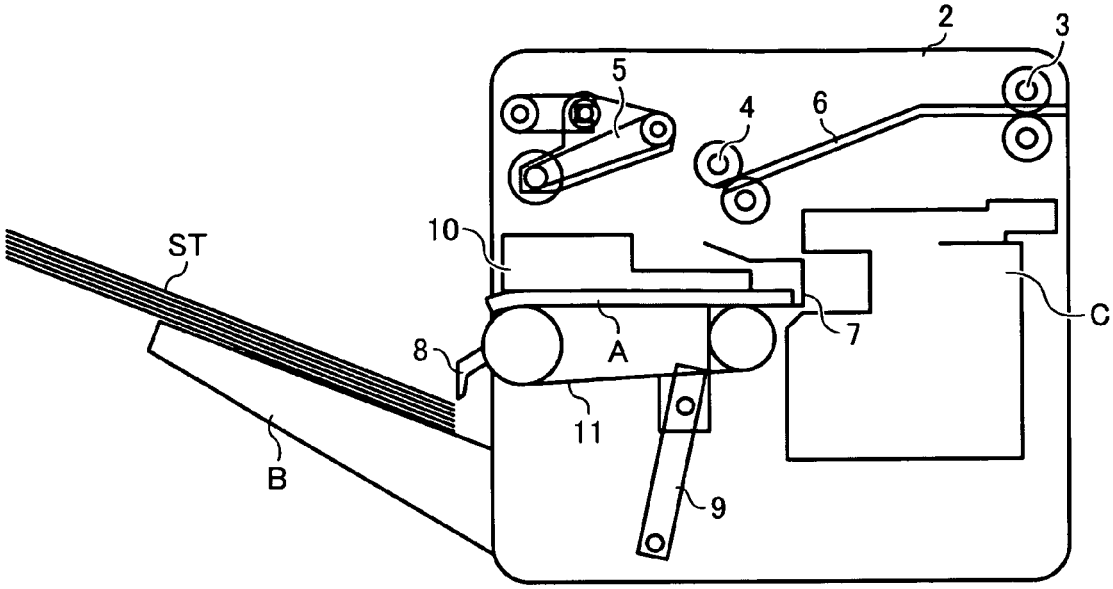
FIG. 19 is a cross-sectional view schematically explaining an operation of the sheet post-processing apparatus and showing a state that the sheets are output on the sheet output tray and the sheet output tray goes down to avoid touching the sheet output nail.
Figure 20:
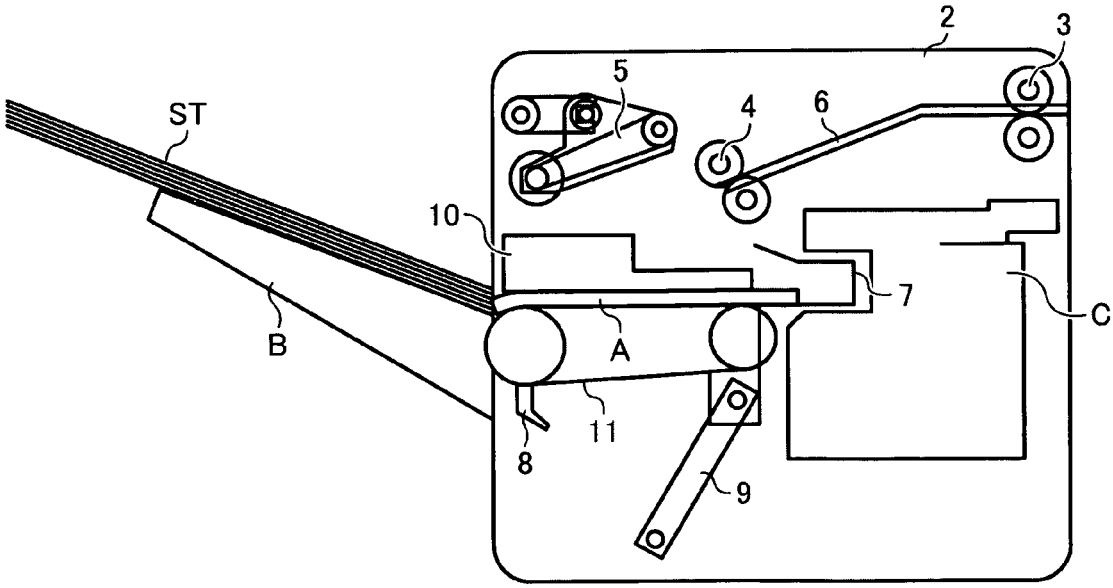
FIG. 20 is a cross-sectional view schematically explaining an operation of the sheet post-processing apparatus and showing a state that the output of the sheets is completed and each member returns to each home position thereof.

When the sheet output nail 8 takes over the output of the stack of sheets ST from the end fence 7 in the state of FIG. 17 and starts to carry the stack of sheets ST toward the sheet output tray B, the end fence 7 starts to return to the home position thereof as shown in FIG. 18. As described above with reference to FIG. 14, a contact point between the driving force transmission cam 24*cam* and the arm 9 moves to the upstream side of the sheet output direction as the motor 20 revolves in the counterclockwise direction. When the arm driving gear 24 makes one revolution from the home position thereof, the arm 9 also returns to the position 9*a* as the home position of the arm 9. While the end fence 7 returns to the home position thereof, the driving force is also transmitted to the sheet output nail driving pulley 11*a* via the sheet output nail driving force transmission pulley 22, and the sheet output nail 8 keeps the stack of sheets ST moving toward the sheet output tray B. When completing the output of the stack of sheets ST onto the sheet output tray B, the sheet output nail 8 pauses, that is, the motor 20 is stopped. Then, the sheet output tray 8 is lowered to a position in which the sheet output nail 8 does not touch the stack of sheets ST output on the sheet output tray B. Subsequently, as shown in FIG. 19, the sheet output nail 8 moves along the sheet output nail driving pulley 11*a* so as not to touch the stack of sheets ST output on the sheet output tray B and returns to the home position of the sheet output nail 8. When the sheet output nail 8 return to the home position thereof, as shown in FIG. 20, the sheet output tray B is raised to a sheet receiving position and waits for output of another stack of sheets. In the state of FIG. 20, the arm 9 is in the position 9*a* in FIGS. 13 and 14. The sheet conveyance driving unit 100 is first in a sheet receiving state shown in FIG. 6, in sheet output states shown in FIGS. 7 and 8, and then in a sheet receiving state shown in FIG. 9.

Figure 21:
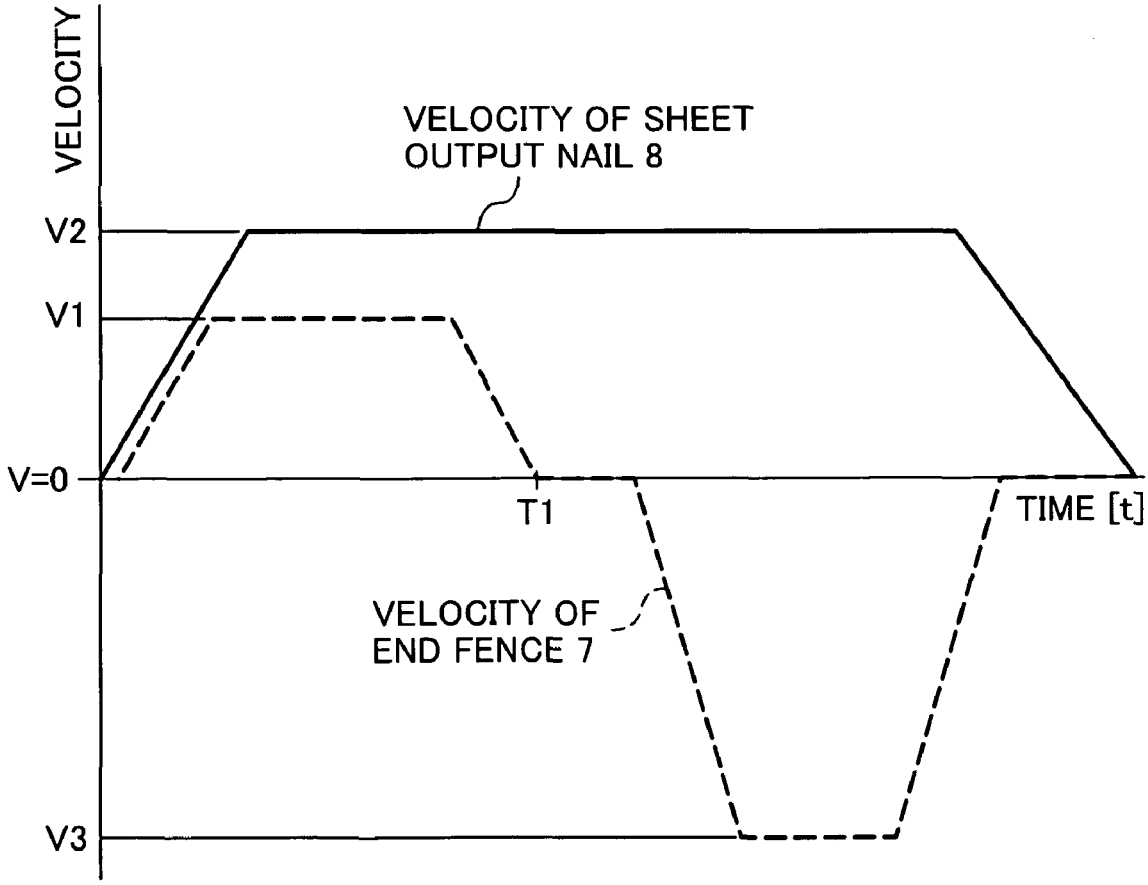
FIG. 21 is a graph showing a velocity relation between the end fence and the sheet output nail.

As described above, according to the present preferred embodiment, while the sheet output nail 8 makes one revolution with the sheet output belt 11, the arm driving gear 24 makes one revolution as well. In the sheet transfer position P (shown in FIG. 17), the end fence 7 pauses, and the sheet output nail 8 takes over the output of the stack of sheets ST. At this point, velocities of the end fence 7 and the sheet output nail 8 is predetermined considering conveyance efficiency of the stack of sheets ST and a jogged condition thereof. The velocity relation between the end fence 7 and the sheet output nail 8 is shown in FIG. 21.

By starting the motor 20, the sheet conveyance driving unit 100 starts to convey the stack of sheets ST. As shown in FIG. 21, the sheet output nail 8 first starts to move. Soon after the sheet output nail 8 moves, the end fence 7 starts to move as well. Hereat, both of the sheet output nail 8 and the end fence 7 accelerate at almost same acceleration. When the velocity of the end fence 7 reaches a predetermined velocity V1, the end fence 7 stops accelerating and conveys the stack of sheets ST at the constant velocity V1. On the other hand, the sheet output nail 8 accelerates to a predetermined velocity V2. When the velocity of the sheet output nail 8 reaches the velocity V2, the sheet output nail 8 moves at the constant velocity V2. As approaching to the sheet transfer position P, the end fence 7 gradually decelerates and pauses at the sheet transfer position P as shown in FIG. 17. While the end fence 7 decelerates and pauses, the sheet output nail 8 still moves at the constant velocity V2. Then, the sheet output nail 8 takes over the output of the stack of sheets ST that has stopped at the sheet transfer position P from the end fence 7, and conveys the stack of sheets ST by contacting the back end thereof toward the sheet output tray B at the constant velocity V2.

When the sheet output nail 8 receives the stack of sheets ST, the end fence 7 returns to the home position thereof. The end fence 7 accelerates at larger acceleration in a direction opposite to the sheet output direction. When the velocity of the end fence 7 reaches a predetermined velocity V3, the end fence 7 moves at the constant velocity V3. When approaches the home position of the end fence 7, the end fence 7 swiftly decelerates and returns to and stops at the home position thereof before the sheet output nail 8 reaches the home position thereof. Thus, as described above, the end fence 7 takes a shorter time period to return to the home position thereof than to move to the sheet transfer position P. Accordingly, the intermediate tray A can accept another sheet earlier.

Figure 22:
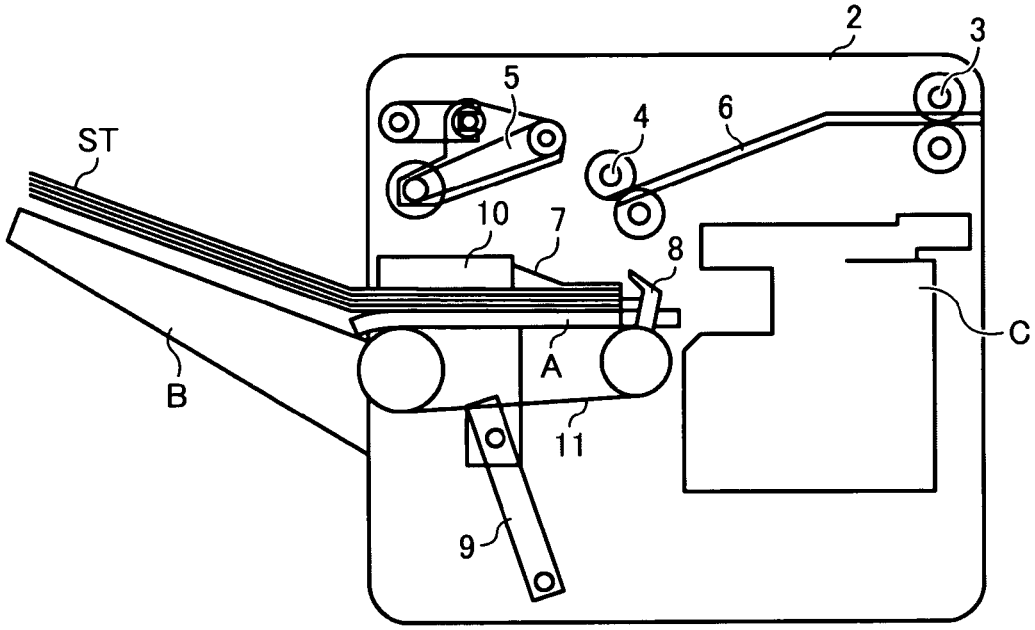
FIG. 22 is a cross-sectional view schematically showing a normal timing for the output nail to receive the sheets when the sheet transfer position is adjusted by using the intermediate gear and the solenoid.
Figure 23:
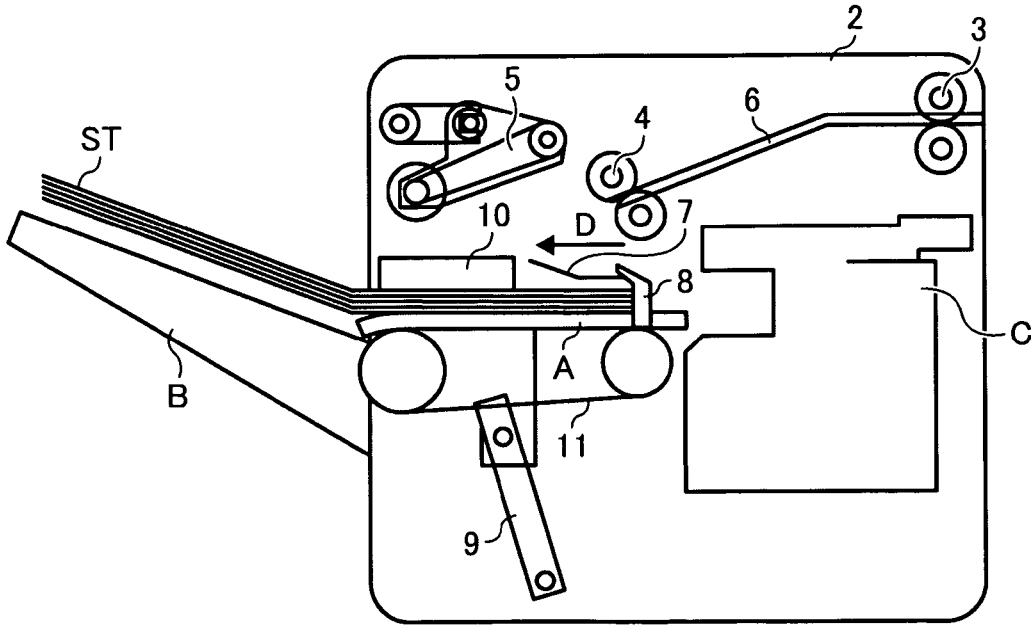
FIG. 23 is a cross-sectional view schematically showing an earlier timing for the output nail to receive the sheets when the sheet transfer position is adjusted by using the intermediate gear and the solenoid.
Figure 24:
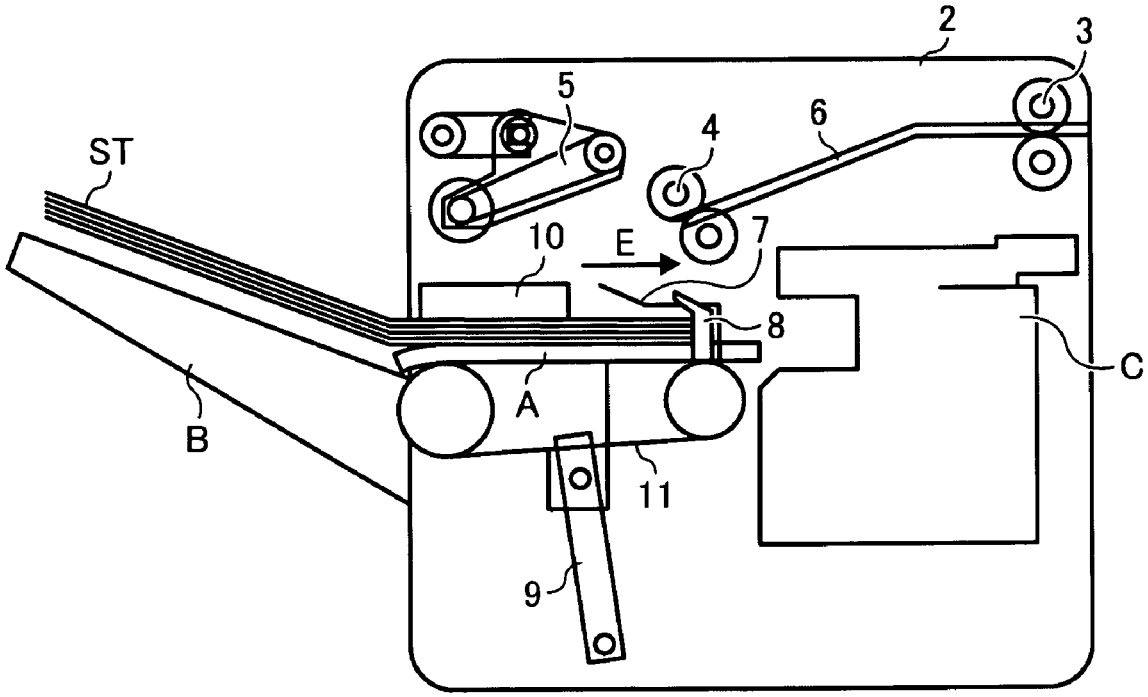
FIG. 24 is a cross-sectional view schematically showing a later timing for the output nail to receive the sheets when the sheet transfer position is adjusted by using the intermediate gear and the solenoid.

In the above description with reference to FIG. 21, when the end fence 7 pauses (hereinafter, a time when the end fence pauses is referred to as T1), the sheet output nail 8 accepts the stack of sheets ST. Alternatively, the time for the sheet output nail 8 to accept the stack of sheets ST can be arbitrarily adjusted. As described above with reference to FIGS. 11 and 12, the intermediate gear 25 changes the driving timing between the arm driving force transmission gear 26 and the arm driving gear 24, and thereby the time of acceptance of the stack of sheets ST by the sheet output nail 8 can be adjusted. FIGS. 22, 23, and 24 show differences in positions at which the sheet output nail 8 accepts the stack of sheets ST. FIG. 22 shows a state that the end fence 7 pauses at the sheet transfer position P (at T1) and the sheet output nail 8 accepts the stack of sheets ST as described above with reference to FIG. 17. FIG. 23 shows that the sheet output nail 8 accepts the stack of sheets ST while the end fence 7 still moves in the sheet output direction (in a direction indicated by an arrow D), in other words, at an earlier time than T1. FIG. 24 shows that the sheet output nail 8 accepts the stack of sheets ST while the end fence 7 moves in the direction opposite to the sheet output direction (in a direction indicated by an arrow E), in other words, at a later time than T1.

As described above, the time of acceptance of the stack of sheets ST by the sheet output nail 8 can be changed depending on a condition of the stack of sheets ST, such as a curl direction or sheet displacement. For example, when a surface of the stack of sheets ST is curled up, the sheet output nail 8 receives the stack of sheets ST earlier as shown in FIG. 23. When the surface of the stack of sheets ST is curled down, the sheet output nail 8 receives the stack of sheets ST later as shown in FIG. 24. Thus, a jogged condition of the stack of sheets ST may be improved when the stack of sheets ST is output on the sheet output tray B. As for the motor 20 in the driving timing change, while the intermediate gear 25 engages with neither the arm driving force transmission gear 26 nor the arm driving gear 24, the motor 20 is revolved by a preset number of pulses in a reverse direction when the time of acceptance of the stack of sheets ST by the sheet output nail 8 is adjusted later, or the motor 20 is revolved by a preset number of pulses in a forward direction when the time of acceptance of the stack of sheets ST by the sheet output nail 8 is adjusted earlier. As a result, the time of acceptance of the stack of sheets ST from the end fence 7 by the sheet output nail 8 can be adjusted while the motor 20 solely drives the sheet conveyance driving unit 100, thus enabling the time of acceptance of the stack of sheets ST by the sheet output nail 8 to be adjusted depending on a sheet condition ejected from the image forming apparatus 1.

The motor 20 can revolves in both forward and reverse directions. Not only to adjust the time of acceptance of the stack of sheets ST by the sheet output nail 8, but also to restart a sheet output operation soon after sheet jamming, the motor 20 can revolves in the reverse direction. More specifically, when the sheet post-processing apparatus 2 restarts the sheet output operation, in order to return the sheet output nail 8 to the home position thereof, it takes a shorter time period to move the sheet output nail 8 by revolving the motor 20 in the forward or reverse directions depending on a jamming point. When the sheet post-processing apparatus 2 can restart the sheet output operation if the sheet output nail 8 rotates in the reverse direction, a CPU described below can instruct the motor 20 to revolve in the reverse direction and the sheet output nail 8 can return to the home position thereof by rotating in the reverse direction. Thus, the sheet jamming can promptly be handled, and efficiency in the sheet output operation can be improved. Accordingly, by enabling the motor 20 to revolve in the forward and reverse directions, broad usability of the sheet post-processing apparatus 2 can be improved, and breakage of the sheet post-processing apparatus can be avoided in advance.

Figure 25:
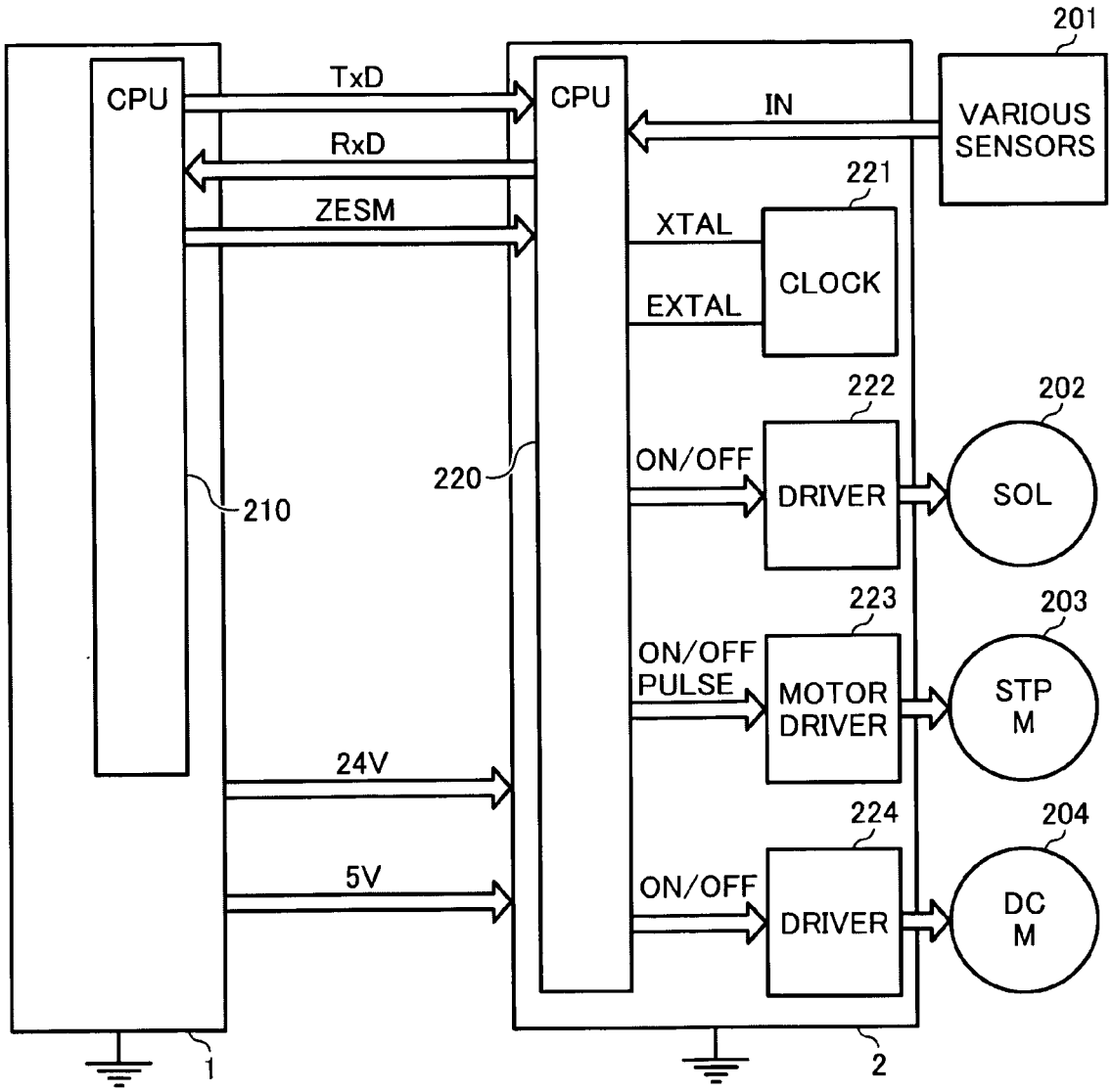
FIG. 25 is a block diagram showing an electronic control system of the system configuration of the image forming apparatus according to the present preferred embodiment.

FIG. 25 shows an electronic control system of the system configuration of the image forming apparatus 1 according to the present preferred embodiment. The image forming apparatus 1 and the sheet post-processing apparatus 2 have CPUs 210 and 220, respectively, and cause the CPU 210 and the CPU 220 to communicate each other (T×D, R×D, ZESM) as required. The image forming apparatus 1 supplies drive voltage (24 V) and control voltage (5 V) to the sheet post-processing apparatus 2, and the image forming apparatus 1 and the sheet post-processing apparatus 2 are at same potential (GND). The sheet post-processing apparatus 2 includes a clock generator 221, a driver 222 for driving a solenoid 202, a motor driver 223 for driving stepping motors 203, and a driver 224 for controlling a direct current motor 204. The CPU 220 sends driving signals to the drivers 222, 223, and 224, respectively, thereby controlling each member in the sheet post-processing apparatus 2. The motor 20 controlling the end fence 7 and the sheet output nail 8 is one of the stepping motors 203 and is driven by the motor driver 223.

Figure 26A:
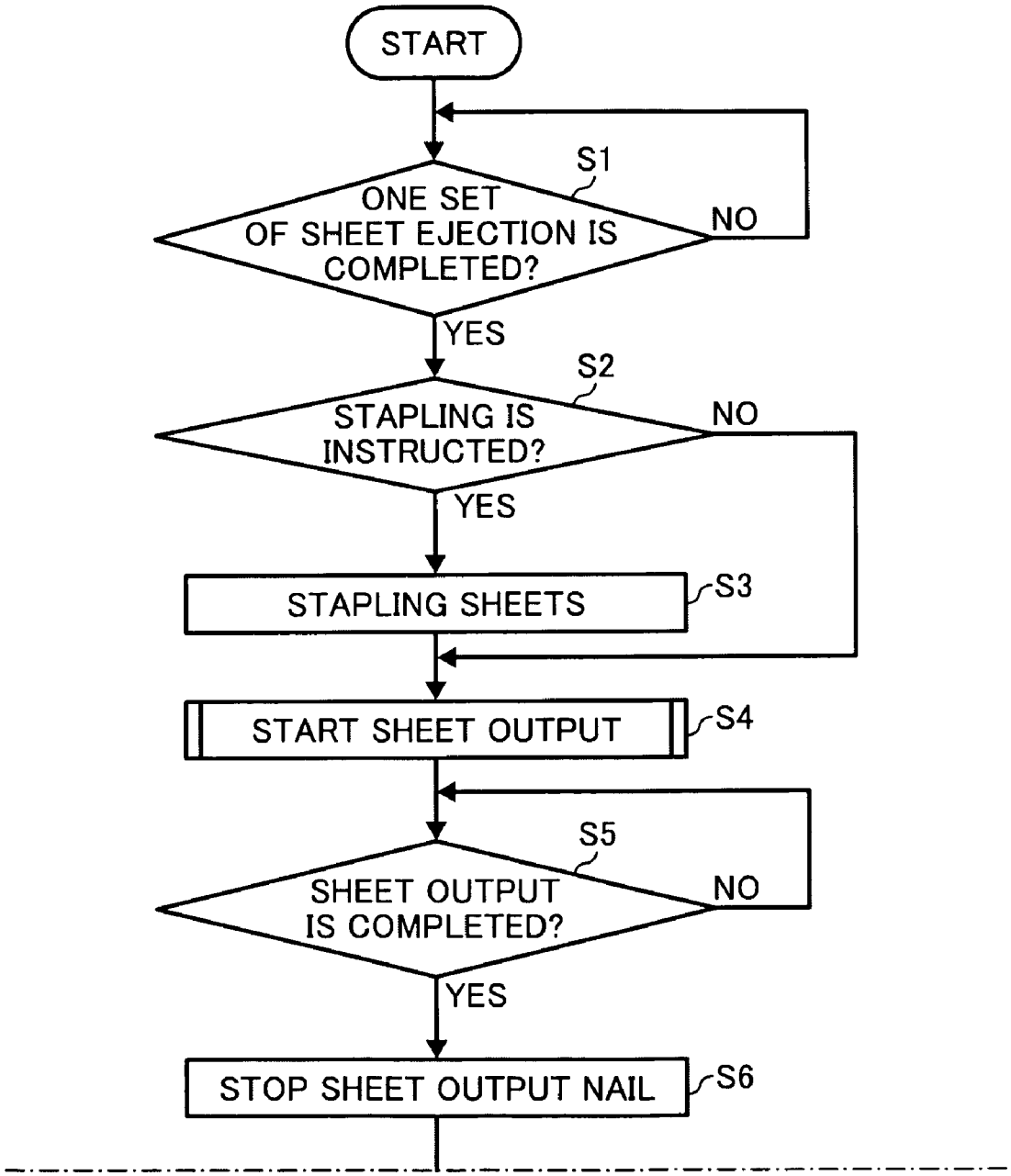
FIGS. 26A and 26B are flow charts showing a procedure to control an output operation of the stack of sheets when the sheet post-processing apparatus performs the operation described with reference to FIGS. 15, 16, 17, 18, 19, and 20.
Figure 26B:
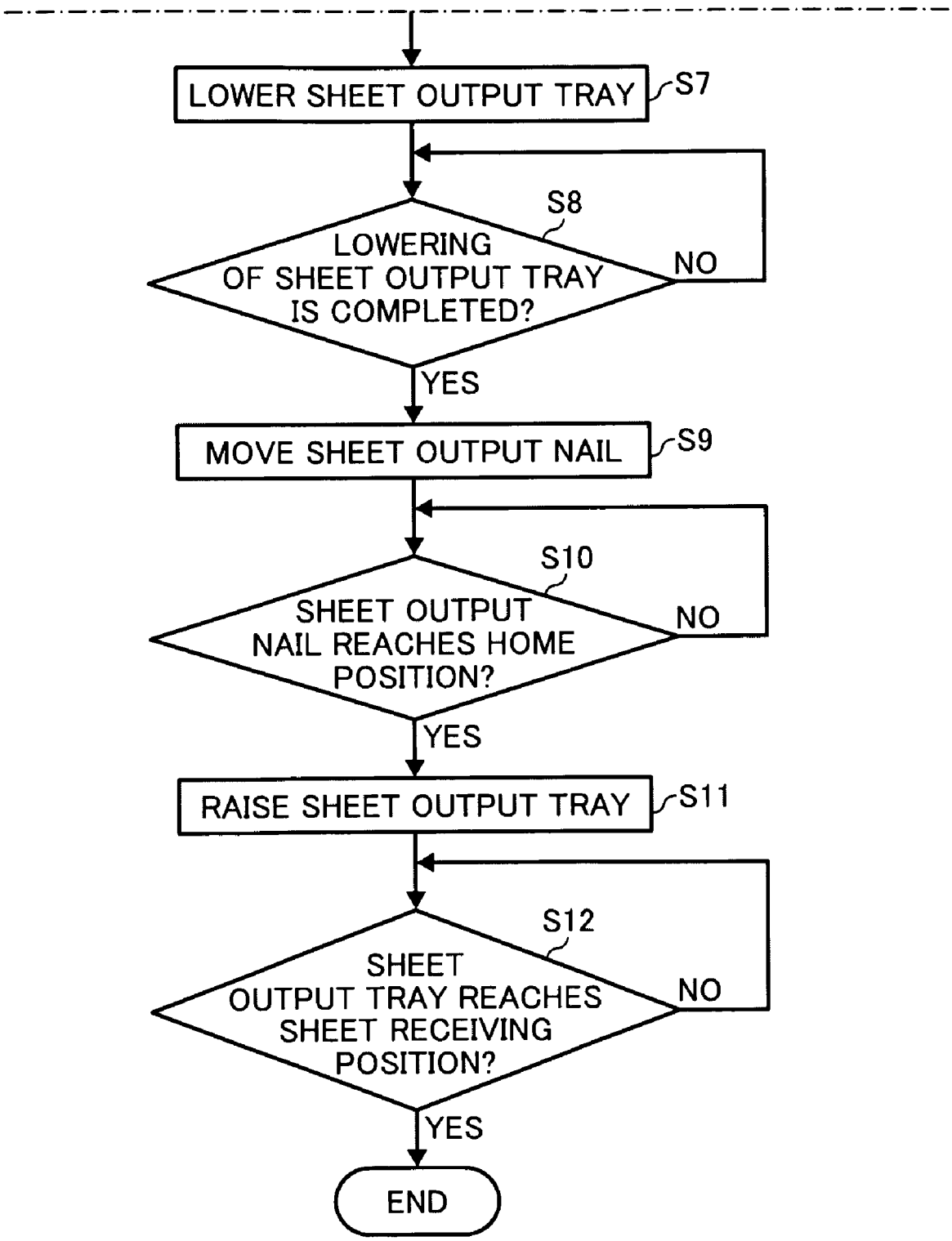

FIGS. 26A and 26B are flow charts showing a procedure for the CPU 220 of the sheet post-processing apparatus 2 to control an output operation of the stack of sheets ST when the sheet post-processing apparatus 2 performs the operation described with reference to FIGS. 15, 16, 17, 18, 19, and 20. When the stack of sheets ST is output from the sheet post-processing apparatus 2, the CPU 220 first verifies whether or not ejection of one set (stack) of sheets is completed onto the intermediate tray A (in step S1). Upon verifying that the ejection is not completed (in step S1: No), the CPU 220 waits for all the sheets to be ejected. Upon verifying that the ejection is completed (in step S1: Yes), the CPU 220 verifies whether or not a user has instructed the image forming apparatus to staple the stack of sheets ST depending on whether or not the CPU 210 of the image forming apparatus 1 has sent a control signal to the CPU 220. Upon verifying that stapling is instructed (in step S2: Yes), the stapler C staples the stack of sheets ST (in step S3). Upon verifying that the stapling is not instructed (in step S2: No), the operation proceeds to step S4. Then, the sheet post-processing apparatus 2 starts to output the stack of sheets ST (in step S4). The processing of step S4 is described above with reference to FIGS. 15, 16, 17, and 18 in detail. Next, the CPU 220 verifies whether or not the output of the stack of sheets ST is completed (in step S5). Upon verifying that the output is not completed (in step S5: No), the CPU 220 waits for the stack of sheets to be output. Upon determining that the output is completed (in step S5: Yes), the CPU 220 stops the sheet output nail 8 (in step S6) and starts to lower the sheet output tray B (in step S7, refer to FIG. 19). Then, the CPU 220 verifies whether or not the sheet output tray B is lowered to a position in which the sheet output nail 8 does not touch the stack of sheets ST output on the sheet output tray B (in step S8). Upon verifying that the sheet output tray B is not lowered to the position (in step S8: No), the CPU 220 waits for the sheet output tray B to be lowered. Upon verifying that the sheet output tray B is lowered to the position (in step S8: Yes), the CPU 220 instructs the sheet output nail 8 to return to the home position thereof (in step S9). Subsequently, the CPU 220 verifies whether or not the sheet output nail 8 returns to the home position thereof (in step S10). Upon verifying that the sheet output nail 8 does not return to the home position thereof (in step S10: No), the CPU 220 waits for the sheet output nail 8 to return the home position. Upon verifying that the sheet output nail 8 returns to the home position (in step S10: Yes), the CPU 220 starts to raise the sheet output tray B (in step S11). Afterwards, the CPU 220 verifies whether or not the sheet output tray B reaches the sheet receiving position (in step S12). Upon verifying that the sheet output tray B does not reach the sheet receiving position (in step S12: No), the CPU 220 waits for the sheet output tray B to reach the sheet receiving position. Upon verifying that the sheet output tray B reaches the sheet receiving position (in step S12: Yes), the CPU 220 stops raising the sheet output tray B. The CPU 220 then terminates the sheet output operation of one stack of sheets and waits for another sheet to be ejected onto the intermediate tray A.

Afterwards, examples of shapes of the sheet output nail 8, relations between the sheet output nail 8 and the intermediate tray A, and output operations of the stack of sheets ST are explained in detail.

Figure 27:
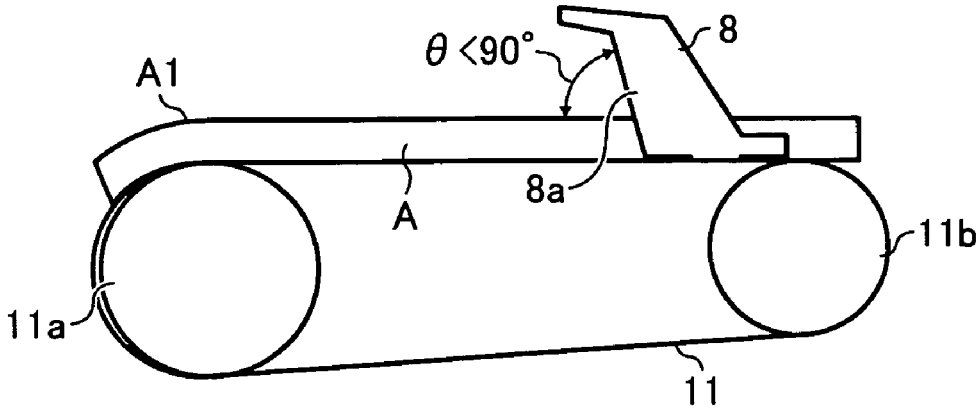
FIG. 27 is a schematic illustration showing a shape of the sheet output nail of a first example.

FIG. 27 shows a first example of a shape of the sheet output nail 8 according to the present preferred embodiment. The first example of the sheet output nail 8 is designed such that an angle θ between a sheet output face 8*a*, which contacts the stack of sheets ST, of the sheet output nail 8 and the sheet stacking face A1 of the intermediate tray A becomes acute (θ<90°).

Figure 28:
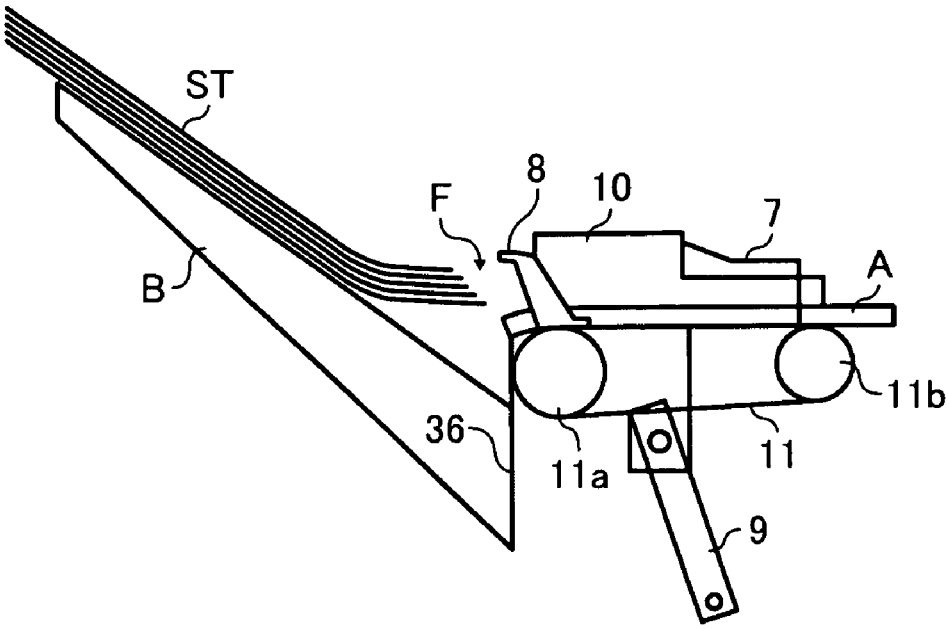
FIG. 28 is a schematic illustration showing a condition of the stack of sheets right after being output on the sheet output tray by the sheet output nail of the first example.
Figure 29:
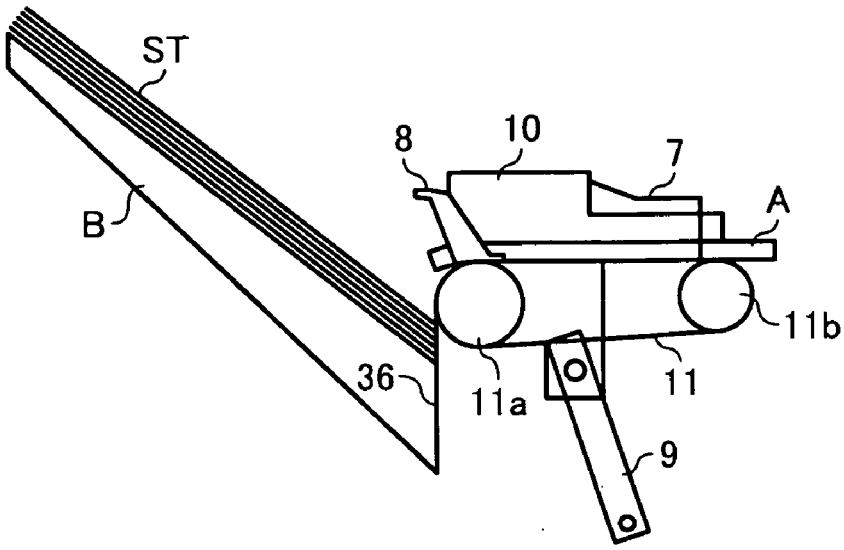
FIG. 29 is a schematic illustration showing a condition of the stack of sheets settled on the sheet output tray after the condition shown in FIG. 28.

FIG. 28 shows a state of the stack of sheets ST right after being output on the sheet output tray B by the sheet output nail 8 designed as shown in FIG. 27. FIG. 29 shows a condition of the stack of sheets ST when settling on the sheet output tray B after the state of FIG. 28. When being output onto the sheet output tray B by the sheet output nail 8 that is designed to have the acute angle θ between the sheet output face 8*a* and the sheet stacking face A1, the stack of sheets ST is output on the sheet output tray B in a state that front ends of upper sheets of the stack of sheets ST go ahead in the sheet output direction as shown in FIG. 28. Then, back ends of the sheets drop in a direction indicated by an arrow F and moves to the backboard 36. At the moment, the back ends of lower sheets of the stack of sheets ST go ahead to the backboard 36. As a result, as shown in FIG. 29, the back end of each sheet of the stack of sheets ST touches the backboard 36, and the stack of sheets ST is jogged on the sheet output tray B.

Figure 30:
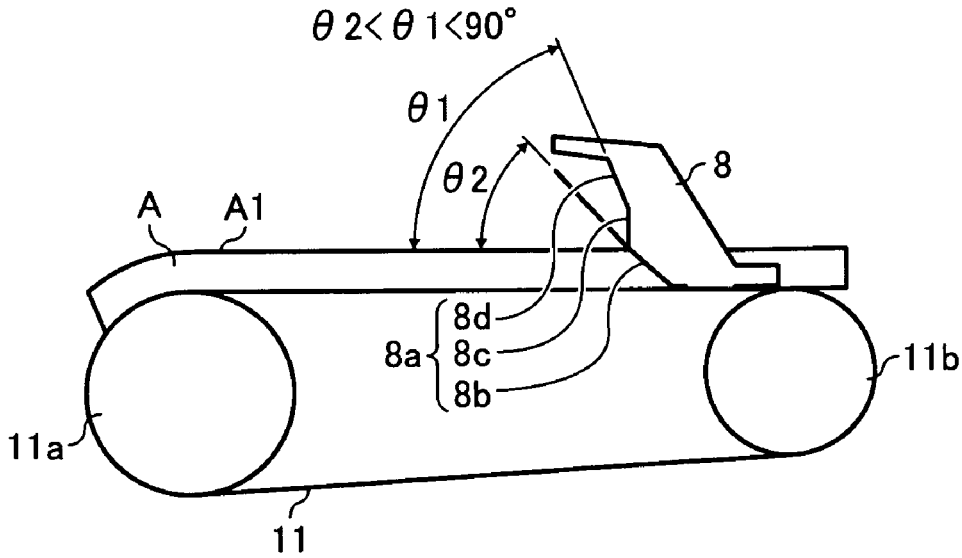
FIG. 30 is a schematic illustration showing a shape of the sheet output nail of a second example.

FIG. 30 shows a second example of the sheet output face 8*a* of the sheet output nail 8 different from the first example shown in FIG. 27. According to the second example, the sheet output face 8*a* is formed of three faces having three different angles with respect to the sheet stacking face A1, that is, a first face 8*b*, a second face 8*c*, and a third face 8*d* from a fixed end of the sheet output nail 8. The first face 8*b* is formed so as to be under the sheet stacking face A1 of the intermediate tray A and is designed to have an acuter angle with respect to the sheet stacking face A1 than angles of the second face 8*c* and the third face 8*d*, which are formed above the sheet stacking face A1, with respect to the sheet stacking face A1. When the angle between the first face 8*b*, the third face 8*d*, or the second face 8*c* and the sheet stacking face A1 is θ2, θ1, or 90°, respectively, a relation of these three angles is configured to be θ2<θ1<90°.

Figure 31:
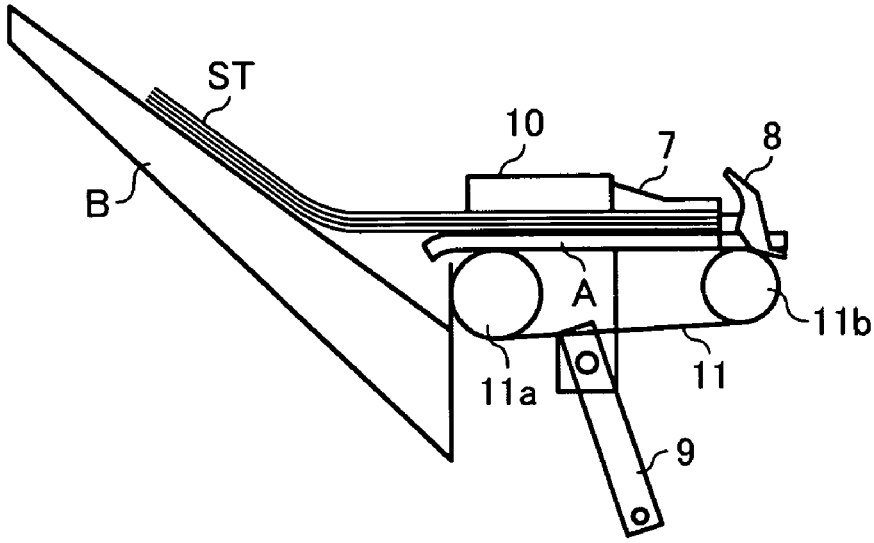
FIG. 31 is a schematic illustration showing an operation of the sheet output nail of the second example right before the sheet output nail receives the stack of sheets.
Figure 32:
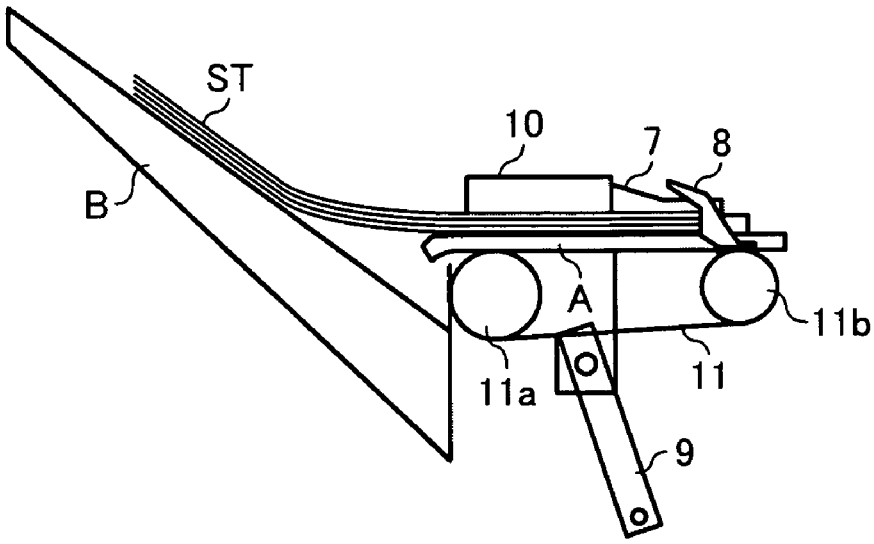
FIG. 32 is a schematic illustration showing an operation of the sheet output nail of the second example right after the sheet output nail receives the stack of sheets.
Figure 33:
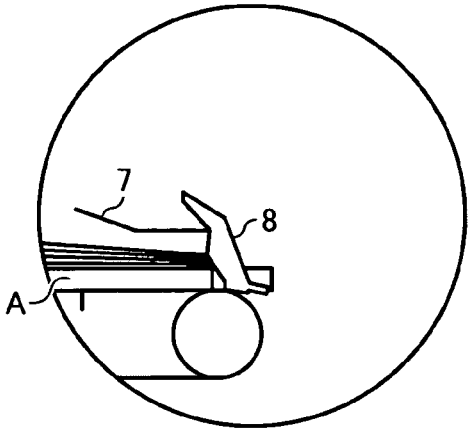
FIG. 33 is a schematic illustration in detail showing an operation of the sheet output nail of the second example when the sheet output nail touches the back end of the stack of sheets.
Figure 34:
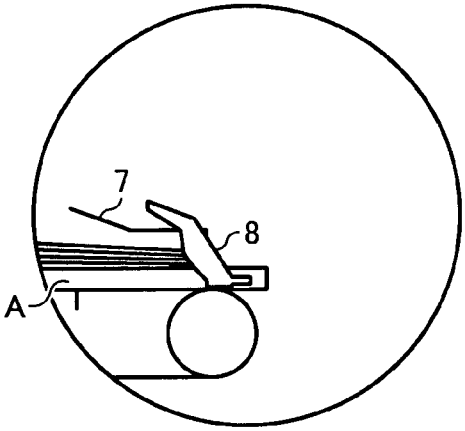
FIG. 34 is a schematic illustration in detail showing an operation of the sheet output nail of the second example when the sheet output nail pushes the stack of sheets while touching the back end of the stack of sheets.
Figure 35:
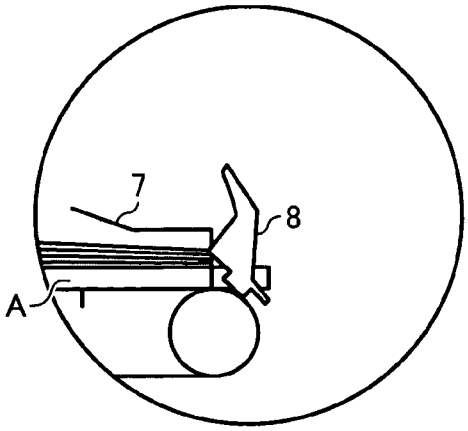
FIG. 35 is a schematic illustration in detail showing an operation of a sheet output nail according to a conventional technique when the sheet output nail touches a back end of a stack of sheets.
Figure 36:
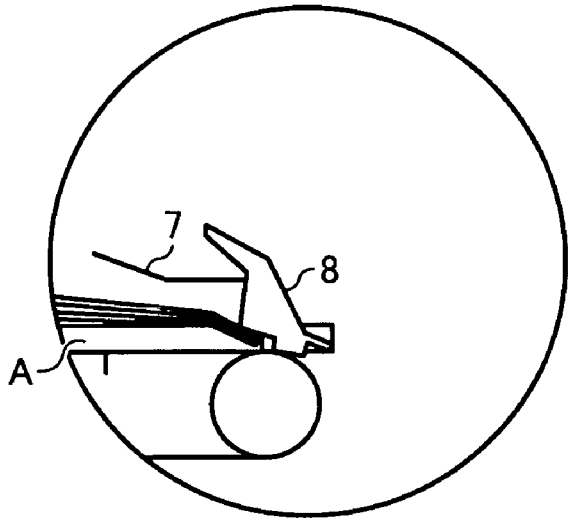
FIG. 36 is a schematic illustration in detail showing an operation of the sheet output nail according to the conventional technique when the sheet output nail pushes the stack of sheets while touching the back end of the stack of sheets.

FIGS. 31 and 32 show operations of the sheet output nail 8 having the sheet output face 8*a* when the sheet output nail 8 accepts the stack of sheets ST. FIGS. 33 and 34 show the sheet output nail 8 in detail when the sheet output nail 8 accepts the stack of sheets ST. In a previous technique, when the time of acceptance of the stack of sheets ST by the sheet output nail 8 is set earlier and the sheet output nail 8 reaches an back end the stack of sheets ST, the sheet output nail 8 may nip the back end of the stack of sheets ST between a fixed end side of the sheet output nail 8 and the sheet stacking face A1 of the intermediate tray A as shown in FIGS. 35 and 36. When nipping the back end of the stack of sheets ST, the sheet output nail 8 carries the stack of sheets ST while nipping the back end and outputs the front end of the stack of sheets ST to the sheet output tray B. However, the back end does not separate from the intermediate tray A. As a result, sheet jamming may occur.

In order to avoid sheet jamming, the sheet output face 8*a* is formed of a plurality of faces, the first face 8*b*, the second face 8*c*, and the third face 8*d*, and the first face 8*b* is formed to have the a cuter angle with respect to the sheet stacking face A1 than angles of the second face 8*c* and the third face 8*d*, which are formed above the sheet stacking face A1. As a result, when the sheet output nail 8 accepts the stack of sheets ST while the end fence 7 moves forward or backward as shown in FIG. 23 or 24, the sheet output nail 8 can avoid pushing or nipping the stack of sheets ST between the sheet output nail 8 and the sheet stacking face A1 of the intermediate tray A as shown in FIG. 31 or 32. Thus, the sheet output nail 8 can output the stack of sheets ST without causing sheet jamming.

Figure 37:
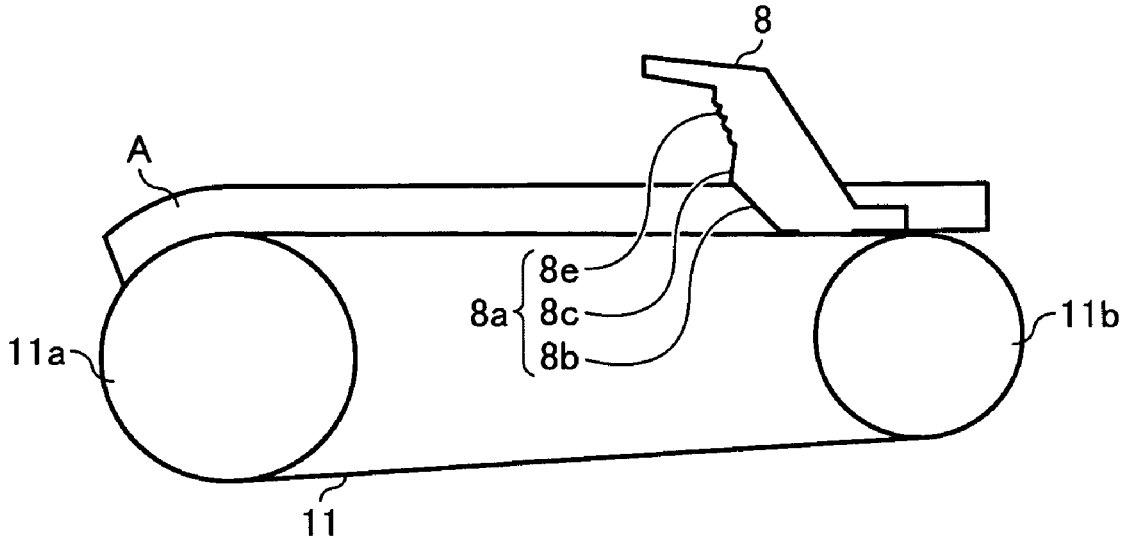
FIG. 37 is a schematic illustration showing a shape of the sheet output nail of a third example.
Figure 38:
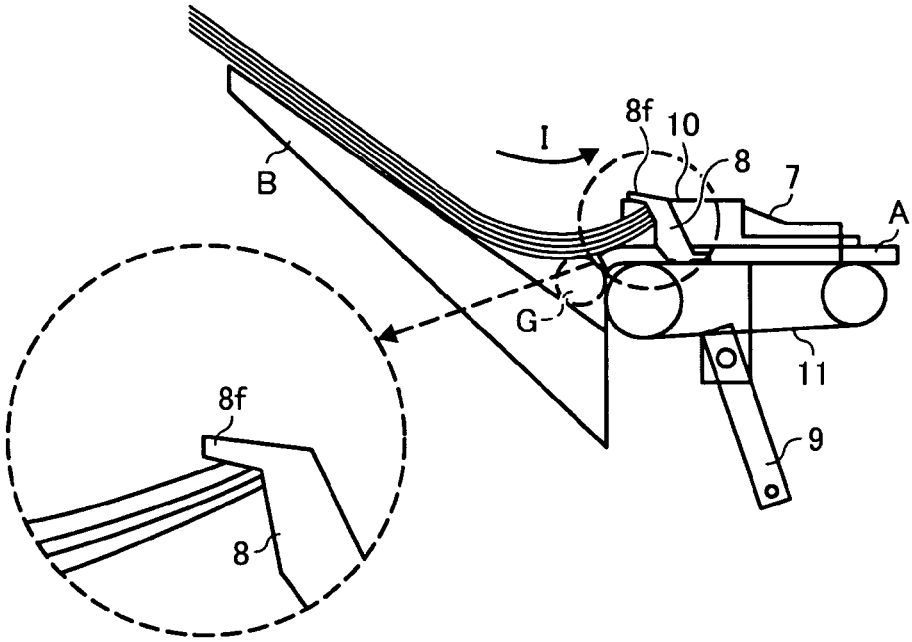
FIG. 38 is a schematic illustration showing a condition that the stack of sheets is buckled with the sheet output nail according to the conventional technique.

FIG. 37 shows a third example of the sheet output face 8*a* of the sheet output nail 8 different from the first or second example shown in FIG. 27 or 30. According to the third example, several notches are formed on the third face 8*d* of the second example. The notches are referred to as a notched area 8*e*. When the stack of sheets ST is output onto the sheet output tray B, stress is applied to the stack of sheets ST in a direction indicated by an arrow I due to the inclined sheet output tray B as shown in FIG. 38. As a result, when the sheet is not elastic and is heavy, as shown in FIG. 38, the stack of sheets ST slides on the sheet output face 8*a*, and the back end of the stack of sheets ST is locked in an interior angle of a salient 8*f* serving as a stopper of the sheet output nail 8. When the sheet output nail 8 conveys the stack of sheets ST toward the sheet output tray B while the back end is locked in the interior angle of the salient 8*f*, the stack of sheets ST may buckle. When the stack of sheets ST buckles, the stack of sheets ST is conveyed while being folded to a space G between the sheet output tray B and a sheet output opening. In other words, inferior sheet output occurs.

Figure 39:
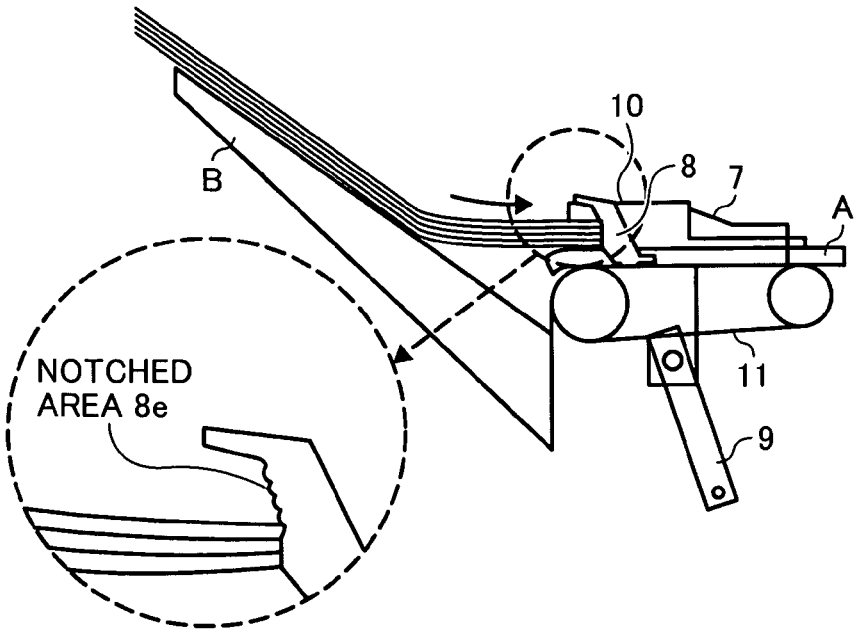
FIG. 39 is a schematic illustration showing an interaction of a notched area formed on the sheet output nail according to the third example with the stack of sheets.

On the other hand, the sliding of the stack of sheets ST on the sheet output face 8*a* can be eliminated by notching an area of the sheet output nail 8 on which the back end of the stack of sheets ST touches as shown in FIGS. 37 and 39. As a result, the buckling of the stack of sheets ST can be eliminated, and the stack of sheets ST may not enter to the space G in a folded state. Thus, the sheet output nail 8 can successfully output the stack of sheets on the sheet output tray B.

Figure 40:
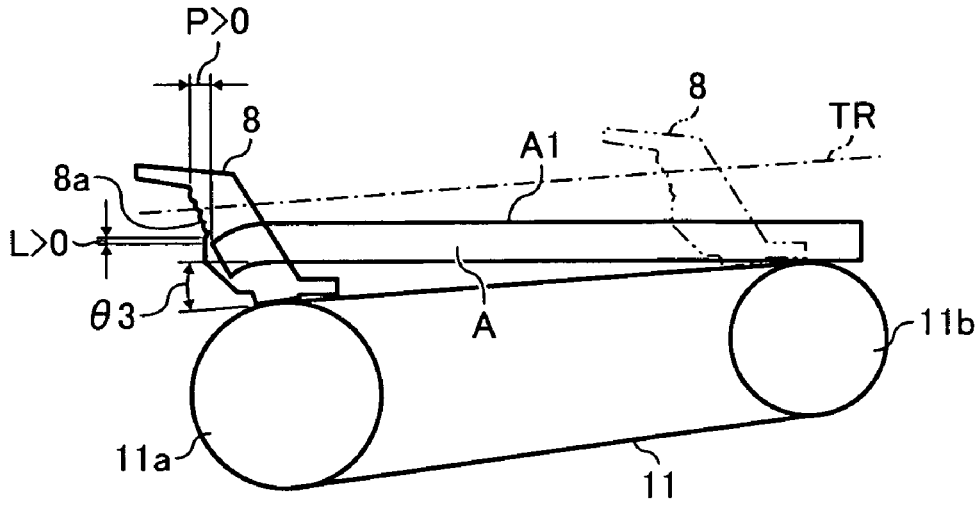
FIG. 40 is a schematic illustration showing a relation between a sheet output nail of a fourth example and the intermediate tray.

FIG. 40 shows a fourth example of a positional relation between the sheet output face 8*a* and the intermediate tray A. In the fourth example, the sheet output belt 11 is disposed such that a downstream side of a moving direction of the sheet output nail 8 is declined. A decline angle is determined such that the fixed end of sheet output nail 8 moves below the intermediate tray A toward the downstream side of the moving direction along a moving path TR. More specifically, the decline angle θ3 is determined corresponding to a maximum sheet number that enables the sheet output nail 8 to avoid nipping the stack of sheets ST between the sheet output nail 8 and the intermediate tray A.

As shown in FIG. 40, after linearly moving toward the sheet output tray B farther than a downstream end of the intermediate tray A, an upper end of the sheet output face 8*a* of the sheet output nail 8 moves along the circumference of the sheet output nail driving pulley 11*a*. At the moment, it is preferred that an interval P from the downstream end of the intermediate tray A to an upper end of the third face 8*d* is determined such that the second and third faces 8*c* and 8*d* of the sheet output face 8*a* appears out of the downstream end of the intermediate tray A.

Figure 41:
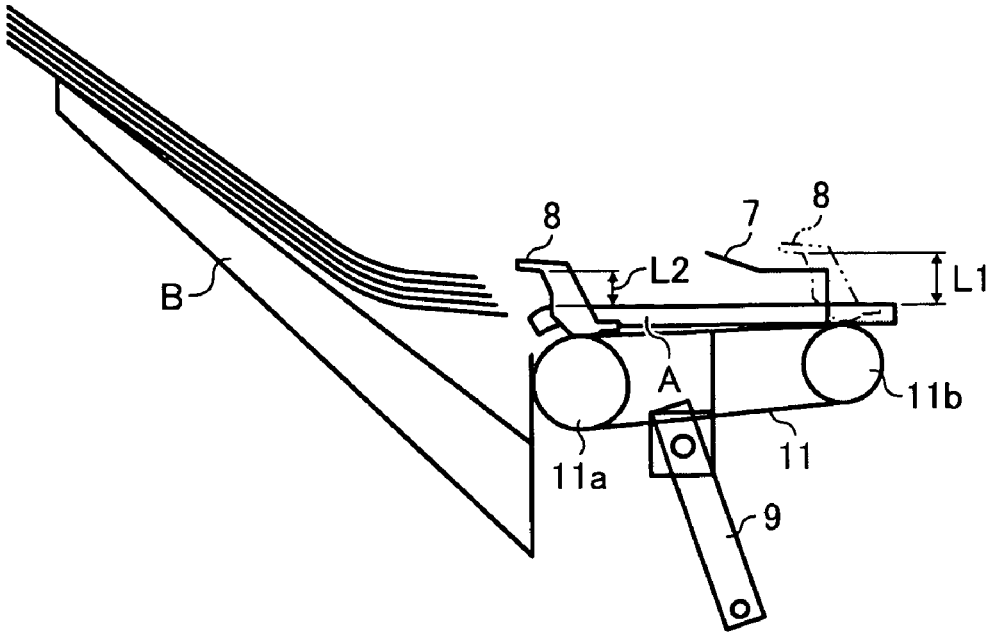
FIG. 41 is a schematic illustration showing an operation of the sheet output nail according to the fourth example.
Figure 42:
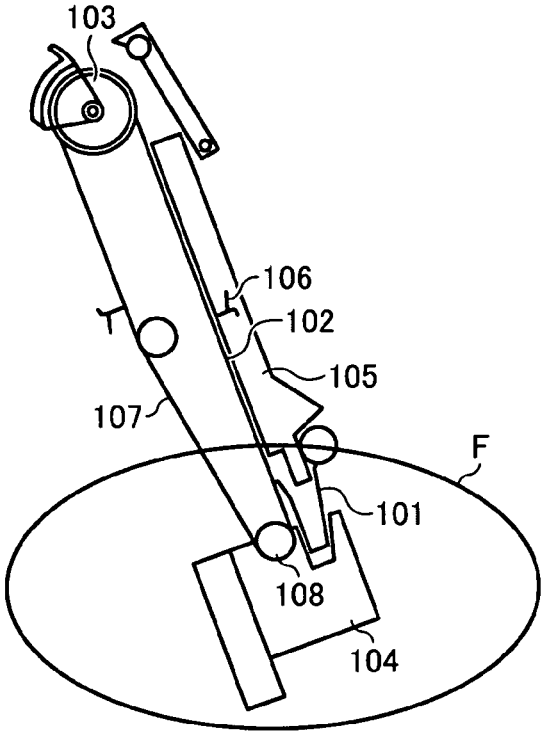
FIG. 42 is a front view of an example of a sheet processing apparatus including a jogging unit and an output unit according to a conventional technique.
Figure 43:
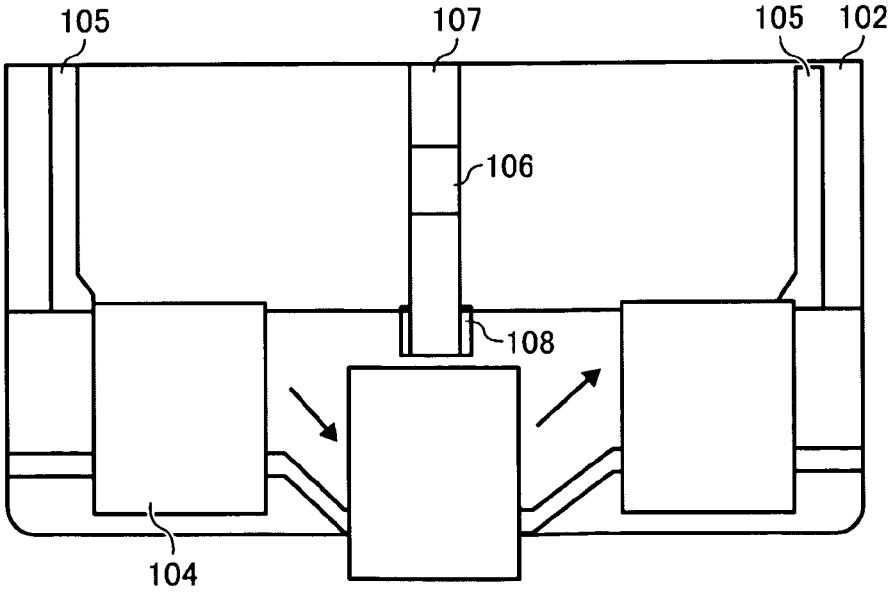
FIG. 43 is a side view showing a magnified F area shown in FIG. 42.
Figure 44:
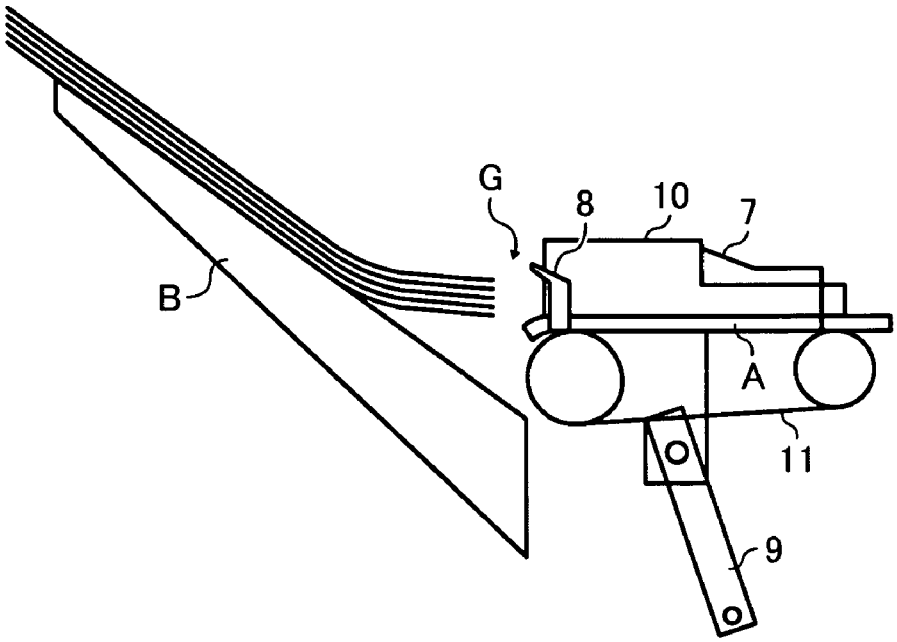
FIG. 44 is a schematic illustration showing an operation of a sheet output nail having a sheet output face vertical to the sheet stacking face A1 of the intermediate tray.
Figure 45:
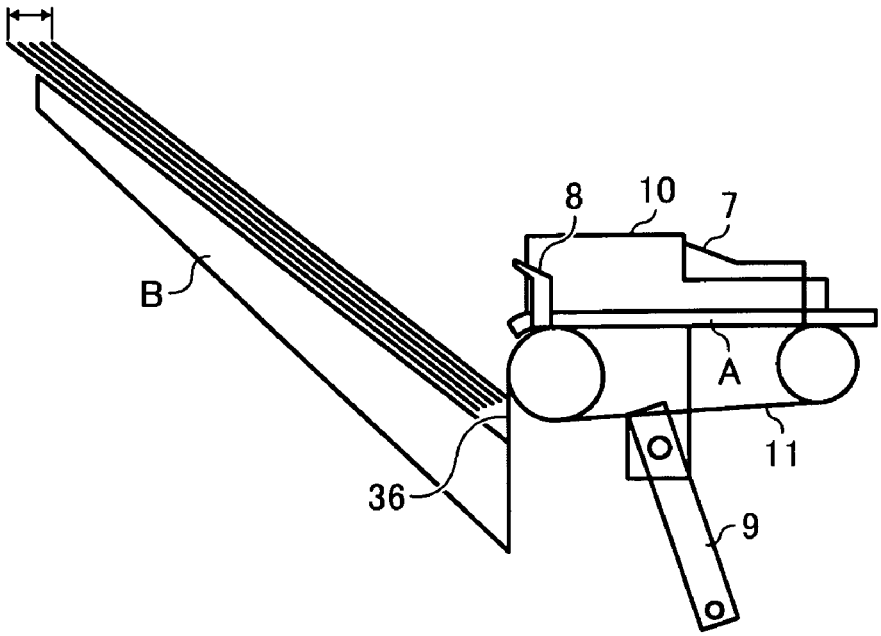
FIG. 45 is a schematic illustration showing a jogged state of the stack of sheets on the sheet output tray that is output by the sheet output nail having the sheet output face vertical to the sheet stacking face A1 of the intermediate tray.

According to the forth example, the moving path TR of the sheet output nail 8 is designed to decline toward the downstream side of the sheet output direction as shown in FIG. 41. Thus, when the height between the upper end of the third face 8*d* and the sheet stacking face A1 at the sheet transfer position and a position closer to the sheet output tray B are referred to as L1 and L2, respectively, L2 becomes smaller than L1 as the sheet output nail 8 approaches to the sheet output tray B due to the decline. In other words, an area in which the stack of sheets ST touches the sheet output nail 8 becomes smaller, and the stack of sheets ST does not largely slide on the sheet output face 8*a*. As a result, the buckling of the back end of the stack of sheets ST can be eliminated more effectively than an example shown in FIG. 39. Accordingly, quality of the stack of sheets ST can be maintained on the sheet output tray B.

Furthermore, according to the forth example, as shown in FIG. 40, when the sheet output nail 8 reaches the downstream end of the intermediate tray A, the decline angle θ3 and the sheet output nail 8 are designed to have an interval L between a lower end of the notched area 8*e* and the intermediate tray A. In order to avoid nipping the stack of sheets ST between the lower end of the notched area 8*e* and the intermediate tray A while conveying the stack of sheets ST, the notched area 8*e* on the sheet output face 8*a* of the sheet output nail 8 is required to remain above the sheet stacking face A1 of the intermediate tray A even when the sheet output nail 8 is in the lowest position with respect to the intermediate tray A.

Both of the interval P and the interval L are configured such that the sheet output nail 8 does not nip the stack of sheets ST while conveying the stack of sheets ST.

According to the present preferred embodiment, since operation periods of the end fence 7 and the sheet output nail 8 are configured to be the same and the end fence 7 and the sheet output nail 8 can move sequentially, the operation periods of the end fence 7 and the sheet output nail 8 does not become out of synchronization. Thus, adjustment of the operation periods is not required.

In addition, since the identical motor drives both the end fence 7 and the sheet output nail 8, another motor that is required when both the end fence 7 and the sheet output nail 8 are separately driven can be omitted. Thus, the sheet post-processing apparatus become smaller, and a decrease in cost may be resulted.

The sheet post-processing apparatus may be implemented to a variety of image forming apparatuses, and therefore a state of a sheet ejected from the variety of image forming apparatuses is different depending on the image forming apparatuses. In the present preferred embodiment, the driving force transmission timing can be adjusted by the intermediate gear 25 and the solenoid 27. Further, the identical motor can drive the end fence 7 and the sheet output nail 8 at different velocities. Thus, the sheet output nail 8 can accept the stack of sheets from the end fence 7 at a different time appropriate to a state of each stack of sheets, such as a curl condition, ejected form a variety of image forming apparatuses. As a result, the stack of sheets can be output more smoothly.

After the sheet output nail 8 accepts the stack of sheets from the end fence 7, the end fence 7 swiftly returns to the home position thereof. Thus, the end fence 7 can wait to receive another stack of sheets earlier, and efficiency in sheet post-processing can increase.

Since the identical motor can revolve in both forward and reverse directions, the sheet conveyance driving unit can operate in both forward and reverse directions as well. Thus, versatility of the sheet post-processing apparatus can be improved, and breakage in an emergency incident can be eliminated.

Since the stapler C can staple the stack of sheets while moving parallel to the back end of the stack of sheets, a space that is conventionally required for the stapler C to avoid the sheet output nail 8 can be omitted. Accordingly, the sheet post-processing apparatus 2 can be smaller in size.

It should be noted that a sheet processing apparatus and a sheet conveyance method according to the present invention may be applied to a variety of image forming apparatuses, and so forth.

Further, it should be noted that the above-described embodiments are merely illustrative, and numerous additional modifications and variations are possible in light of the above teachings. For example, elements and/or features of different illustrative and preferred embodiments herein may be combined with each other and/or substituted for each other within the scope of this disclosure. It is therefore to be understood that the disclosure of this patent specification may be practiced otherwise than as specifically described herein.

What is claimed is:

1. A sheet processing apparatus configured to perform predetermined processing on a sheet conveyed thereto and to output the sheet therefrom, comprising:

a sheet stacking member configured to temporarily receive a sheet conveyed thereto and to stack the sheet;

a first conveyance unit configured to convey the sheet by touching a back end of a stack of sheets stacked on the sheet stacking member and pushing the stack of sheets to a sheet transfer position;

a second conveyance unit configured to receive the stack of sheets from the first conveyance unit in the sheet transfer position and to output the stack of sheets from the sheet stacking member; and a drive unit configured to drive all movement of the first conveyance unit and the second conveyance unit by using driving force supplied from a single drive source.

2. The sheet processing apparatus according to claim 1, further comprising a timing set unit configured to set a timing of reception of the stack of sheets from the first conveyance unit in the sheet transfer position by the second conveyance unit.

3. The sheet processing apparatus according to claim 1, wherein the drive unit drives the first conveyance unit and the second conveyance unit so that a conveyance velocity of the stack of sheets conveyed by the first conveyance unit is lower than a conveyance velocity of the stack of sheets conveyed by the second conveyance unit.

4. The sheet processing apparatus according to claim 1, wherein the drive unit drives the first conveyance unit so that a return velocity of the first conveyance unit when the first conveyance unit returns to a home position thereof is higher than an initial velocity of the first conveyance unit when the first conveyance unit goes to the sheet transfer position.

5. The sheet processing apparatus according to claim 1, wherein the single drive source drives the drive unit in both forward and reverse directions.

6. The sheet processing apparatus according to claim 1, further comprising:

a stapling unit configured to staple a stack of sheets; and a holding member configured to movably hold the stapling unit parallel to a back end of the stack of sheets.

7. The sheet processing apparatus according to claim 1, wherein the second conveyance unit includes a sheet output face which contacts the stack of sheets, an angle between the sheet output face and a stacking face of the sheet stacking member being acute.

8. The sheet processing apparatus according to claim 1, wherein the drive unit further comprises:

an arm driving force transmission pulley to move the first conveyance unit;

a sheet output nail driving force transmission pulley to move the second conveyance unit; and a relay pulley driven by the single driving source, the relay pulley supplying the driving force to both the arm driving force transmission pulley and the sheet output nail driving force transmission pulley.

9. The sheet processing apparatus according to claim 8, wherein the drive unit further comprises:

an arm driving shaft, the arm driving shaft being driven by the arm driving force transmission pulley;

an arm driving force transmission gear being rotated by the arm driving shaft; and an arm driving gear with a driving force cam protruding outside an outer circumference of the arm driving gear, the arm driving gear being rotated by the arm driving force transmission gear, the driving force cam being concentrically rotated by the arm driving gear to swingably drive an arm that moves the first conveyance unit.

* * * * *